US011206891B2

(12) United States Patent
Beers et al.

(10) Patent No.: US 11,206,891 B2
(45) Date of Patent: Dec. 28, 2021

(54) ARTICLE OF FOOTWEAR AND A METHOD OF ASSEMBLY OF THE ARTICLE OF FOOTWEAR

(71) Applicant: NIKE, Inc., Beaverton, OR (US)

(72) Inventors: Tiffany A. Beers, Portland, OR (US); Andrew A. Owings, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/723,972

(22) Filed: May 28, 2015

(65) Prior Publication Data

US 2016/0345679 A1 Dec. 1, 2016
US 2020/0275740 A9 Sep. 3, 2020

Related U.S. Application Data

(60) Continuation-in-part of application No. 14/310,586, filed on Jun. 20, 2014, now Pat. No. 9,307,804, which is a continuation of application No. 13/955,007, filed on Jul. 31, 2013, now Pat. No. 8,769,844, which is a continuation of application No. 13/236,221, filed on Sep. 19, 2011, now Pat. No. 8,522,456, which is a (Continued)

(51) Int. Cl.

| | |
|---|---|
| ***A43B 3/00*** | (2006.01) |
| ***A43C 11/16*** | (2006.01) |
| ***A43B 23/07*** | (2006.01) |
| ***A43B 19/00*** | (2006.01) |
| ***A43C 11/00*** | (2006.01) |

(52) U.S. Cl.

CPC ..... *A43B 3/0005* (2013.01); *A43B 3/001* (2013.01); *A43B 19/00* (2013.01); *A43B 23/07* (2013.01); *A43C 11/004* (2013.01); *A43C 11/165* (2013.01)

(58) Field of Classification Search

CPC ..... A43B 23/07; A43C 1/003; A43C 7/00; A43C 7/08; A43C 11/165

See application file for complete search history.

(56) References Cited

U.S. PATENT DOCUMENTS 3,008,038 A 11/1961 Dickens
3,070,907 A 1/1963 Joseph
(Continued)

FOREIGN PATENT DOCUMENTS

CN 2173521 Y 8/1994
CN 2438353 Y 7/2001
(Continued)

OTHER PUBLICATIONS

"International Application Serial No. PCT/US2016/032251, International Search Report dated Aug. 22, 2016", 4 pgs.
(Continued)

*Primary Examiner* — Megan E Lynch
(74) *Attorney, Agent, or Firm* — Schwegman Lundberg & Woessner, P.A.

(57) ABSTRACT

An article of footwear can include provisions for facilitating the installation of various components. During manufacture of the article of footwear, the upper and/or sole structure can include one or more specialized compartments designed to receive the components. The components can be installed in compartments after manufacture of the article of footwear. In some cases, the components can be used to perform different functions in a motorized tensioning system.

11 Claims, 21 Drawing Sheets

Related U.S. Application Data division of application No. 12/114,022, filed on May 2, 2008, now Pat. No. 8,046,937.

(56) References Cited

U.S. PATENT DOCUMENTS 3,496,505 A 2/1970 Johannsen et al.
3,668,791 A 6/1972 Salzman et al.
3,893,247 A 7/1975 Dana, III
3,946,505 A 3/1976 Dana, III
4,020,572 A 5/1977 Chiaramonte, Jr.
4,112,601 A 9/1978 Chiaramonte
4,130,951 A 12/1978 Powell
4,158,922 A 6/1979 Dana, III
4,253,253 A 3/1981 Mccormick
4,426,796 A 1/1984 Spademan
4,433,456 A 2/1984 Baggio
4,466,204 A 8/1984 Wu
4,494,324 A 1/1985 Spademan
4,551,933 A 11/1985 Morell et al.
4,619,057 A 10/1986 Sartor et al.
4,644,671 A 2/1987 Walkhoff
4,670,999 A 6/1987 Olivieri
4,724,626 A 2/1988 Baggio
4,741,115 A 5/1988 Pozzobon
4,848,009 A 7/1989 Rodgers
4,895,110 A 1/1990 LoCascio
4,922,634 A 5/1990 Seidel
4,924,605 A 5/1990 Spademan
4,999,936 A 3/1991 Calamia et al.
5,033,212 A 7/1991 Evanyk
5,060,402 A 10/1991 Rosen
5,157,813 A 10/1992 Carroll
5,174,051 A 12/1992 Walkhoff et al.
5,188,447 A 2/1993 Chiang et al.
5,205,055 A 4/1993 Harrell
5,245,516 A 9/1993 De Haas et al.
5,285,586 A 2/1994 Goldston et al.
5,303,131 A 4/1994 Wu
5,303,485 A 4/1994 Goldston et al.
5,311,677 A 5/1994 Mann et al.
5,311,678 A 5/1994 Spademan
5,325,613 A 7/1994 Sussmann
5,329,432 A 7/1994 Bland
5,373,651 A 12/1994 Wood
5,381,615 A 1/1995 Macmillan
5,396,718 A 3/1995 Schuler et al.
5,396,720 A 3/1995 Hwang et al.
5,406,724 A 4/1995 Lin
5,408,764 A 4/1995 Wut
5,457,900 A 10/1995 Roy
5,461,188 A 10/1995 Drago et al.
5,469,342 A 11/1995 Chien
5,479,325 A 12/1995 Chien
5,483,759 A 1/1996 Silverman
5,490,338 A 2/1996 Hwang et al.
5,495,136 A 2/1996 Chiang et al.
5,499,459 A * 3/1996 Tomaro ..... A43B 1/0045 36/10
5,500,635 A 3/1996 Mott
5,546,681 A 8/1996 Goldston et al.
5,570,945 A 11/1996 Chien et al.
5,572,817 A 11/1996 Chien
5,592,759 A 1/1997 Cox
5,599,088 A 2/1997 Chien
5,611,621 A 3/1997 Chien
5,644,858 A 7/1997 Bemis
5,647,104 A 7/1997 James
5,649,755 A 7/1997 Rapisarda
5,651,197 A 7/1997 James
5,692,324 A 12/1997 Goldston et al.
5,704,705 A 1/1998 Chien
5,704,706 A 1/1998 Goldston et al.
5,722,757 A * 3/1998 Chien ..... A43B 1/0072 36/137
5,732,486 A 3/1998 Rapisarda
5,746,499 A 5/1998 Ratcliffe et al.
5,765,300 A 6/1998 Kianka
5,771,611 A 6/1998 Chang
5,791,021 A 8/1998 James
5,794,366 A 8/1998 Chien
5,806,960 A 9/1998 Chien
5,812,063 A 9/1998 Weng et al.
5,813,148 A 9/1998 Guerra
5,829,169 A 11/1998 James
5,839,210 A 11/1998 Bernier et al.
5,857,273 A 1/1999 Rapisarda
5,860,727 A 1/1999 Chien
5,865,523 A 2/1999 Chien
5,866,987 A 2/1999 Wut
5,879,069 A 3/1999 Chien
5,894,201 A 4/1999 Wong
5,894,686 A 4/1999 Parker et al.
5,909,088 A 6/1999 Wut
5,930,921 A 8/1999 Sorofman et al.
5,933,985 A 8/1999 James
5,934,599 A 8/1999 Hammerslag
5,947,580 A 9/1999 Chien
5,950,335 A 9/1999 Okajima
5,955,957 A 9/1999 Calabrese et al.
5,969,479 A 10/1999 Wong
5,983,530 A * 11/1999 Chou ..... A43C 1/04 36/118.1
6,012,822 A 1/2000 Robinson
6,017,128 A 1/2000 Goldston et al.
6,032,387 A 3/2000 Johnson
6,035,556 A 3/2000 Ballinger et al.
6,052,921 A 4/2000 Oreck
6,104,140 A 8/2000 Wut
6,112,437 A 9/2000 Lovitt
6,199,305 B1 3/2001 Steuerwald et al.
6,202,953 B1 3/2001 Hammerslag
6,280,045 B1 8/2001 Anteby et al.
6,289,558 B1 9/2001 Hammerslag
6,378,230 B1 * 4/2002 Rotem ..... A43C 11/16 36/118.1
6,427,361 B1 * 8/2002 Chou ..... A43B 11/00 36/138
6,457,261 B1 10/2002 Crary
6,467,194 B1 10/2002 Johnson
6,619,812 B2 9/2003 Rapisarda
6,643,954 B2 * 11/2003 Voswinkel ..... A43B 11/00 36/138
6,691,433 B2 2/2004 Liu
6,764,193 B1 7/2004 Wei
6,788,200 B1 9/2004 Jamel et al.
6,789,913 B2 9/2004 Wei
6,837,590 B2 1/2005 Marston
6,843,578 B1 1/2005 Cheung
6,896,128 B1 * 5/2005 Johnson ..... A43C 1/06 36/118.1
6,925,734 B1 8/2005 Schaeffer
6,952,891 B2 10/2005 Hirayama
6,991,342 B2 1/2006 Gonet
7,059,069 B2 6/2006 Raluy et al.
7,096,559 B2 8/2006 Johnson
7,103,994 B2 9/2006 Johnson
7,114,822 B2 10/2006 Guzman
7,147,337 B1 12/2006 Rapisarda
7,178,929 B2 2/2007 Guzman
7,181,870 B2 2/2007 Guzman
7,188,439 B2 3/2007 Dibenedetto et al.
7,210,253 B2 5/2007 Yu
7,225,565 B2 6/2007 DiBenedetto et al.
7,254,910 B2 8/2007 Guzman
7,255,468 B2 8/2007 Capriola
7,395,614 B1 7/2008 Bailey, Sr. et al.
7,503,131 B2 3/2009 Nadel et al.
7,510,293 B2 3/2009 Chyn
7,596,891 B2 10/2009 Carnes et al.
7,607,243 B2 10/2009 Berner, Jr. et al.
7,721,468 B1 * 5/2010 Johnson ..... A43C 1/06 36/118.1
7,752,774 B2 7/2010 Ussher
7,789,520 B2 9/2010 Konig et al.

(56) References Cited

U.S. PATENT DOCUMENTS 7,794,101 B2 9/2010 Galica et al.
8,046,937 B2 11/2011 Beers et al.
8,056,269 B2 11/2011 Beers et al.
8,058,837 B2 * 11/2011 Beers ..... A43B 1/0036 320/107
8,086,421 B2 12/2011 Case, Jr. et al.
8,234,798 B2 8/2012 DiBenedetto et al.
8,384,551 B2 2/2013 Ross et al.
8,463,657 B1 7/2013 Bentvelzen et al.
8,522,456 B2 9/2013 Beers et al.
8,528,235 B2 9/2013 Beers et al.
8,628,453 B2 1/2014 Balakrishnan et al.
8,745,896 B2 6/2014 Dua et al.
8,769,844 B2 7/2014 Beers et al.
8,771,148 B2 7/2014 Balakrishnan et al.
8,879,685 B2 11/2014 Oshio
8,935,860 B2 * 1/2015 Torres ..... A43B 3/0005 36/138
8,938,892 B2 1/2015 Case, Jr.
1,184,396 A1 5/2016 Trimble
9,907,359 B2 3/2018 Beers et al.
9,943,139 B2 4/2018 Beers et al.
2002/0095750 A1 7/2002 Hammerslag
2003/0066207 A1 4/2003 Gaither
2003/0070324 A1 4/2003 Nelson
2003/0150135 A1 8/2003 Liu
2004/0103563 A1 6/2004 Linge
2004/0181972 A1 9/2004 Csorba
2004/0255490 A1 12/2004 Wan et al.
2005/0018417 A1 1/2005 Chien
2005/0018450 A1 1/2005 Chien
2005/0126043 A1 6/2005 Reagan et al.
2005/0183294 A1 8/2005 Guzman
2005/0198867 A1 * 9/2005 Labbe ..... A43B 11/00 36/50.1
2005/0207138 A1 9/2005 Cheung
2005/0235523 A1 10/2005 Flechsig et al.
2005/0284001 A1 12/2005 Hoffman et al.
2005/0286244 A1 12/2005 Weng
2005/0286248 A1 12/2005 Weng
2006/0002134 A1 1/2006 Capriola
2006/0007668 A1 1/2006 Chien
2006/0007670 A1 1/2006 Chien
2006/0053659 A1 * 3/2006 Johnson ..... A43B 11/00 36/56
2006/0101674 A1 5/2006 Ungari
2006/0156517 A1 7/2006 Hammerslag et al.
2006/0156588 A1 7/2006 Ferrell
2006/0198121 A1 9/2006 Thorpe et al.
2006/0221596 A1 10/2006 Chang
2006/0262517 A1 11/2006 Doerer et al.
2007/0000154 A1 1/2007 Dibenedetto et al.
2007/0011912 A1 1/2007 Clark et al.
2007/0011914 A1 1/2007 Keen et al.
2007/0011919 A1 1/2007 Case
2007/0011920 A1 1/2007 Dibenedetto et al.
2007/0028486 A1 2/2007 Montanya et al.
2007/0041193 A1 2/2007 Wong et al.
2007/0130804 A1 5/2007 Levy et al.
2007/0147026 A1 6/2007 Tseng
2007/0180736 A1 8/2007 Dibenedetto et al.
2007/0180737 A1 8/2007 Dibenedetto et al.
2007/0201221 A1 8/2007 Cherdak et al.
2007/0211451 A1 9/2007 Chung
2007/0236915 A1 10/2007 Chen
2007/0267398 A1 11/2007 Mccoy
2008/0054845 A1 3/2008 Wang
2008/0060224 A1 3/2008 Whittlesey et al.
2008/0086911 A1 4/2008 Labbe
2008/0197126 A1 8/2008 Bourke et al.
2008/0203144 A1 * 8/2008 Kim ..... A61B 5/00 235/105
2008/0246439 A1 10/2008 Tsui et al.
2008/0301919 A1 * 12/2008 Ussher ..... A43B 3/0005 24/712.7
2008/0307673 A1 * 12/2008 Johnson ..... A43B 11/00 36/50.1
2009/0199435 A1 * 8/2009 Robinson, Jr. ..... A43C 1/06 36/108
2009/0272007 A1 * 11/2009 Beers ..... A43B 3/0005 36/50.1
2009/0272013 A1 11/2009 Beers et al.
2010/0033321 A1 2/2010 Kaminski et al.
2010/0037489 A1 2/2010 Berner, Jr. et al.
2010/0115799 A1 5/2010 Welter et al.
2010/0223816 A1 9/2010 Barfield
2011/0054359 A1 3/2011 Sazonov et al.
2011/0107771 A1 5/2011 Crist et al.
2011/0175744 A1 7/2011 Englert et al.
2011/0225843 A1 9/2011 Kerns et al.
2011/0258876 A1 * 10/2011 Baker ..... A43C 11/008 36/50.1
2011/0260857 A1 10/2011 Hamill
2011/0266384 A1 11/2011 Goodman et al.
2012/0000091 A1 1/2012 Cotterman et al.
2012/0192462 A1 8/2012 Hsu
2012/0234111 A1 9/2012 Molyneux et al.
2013/0019694 A1 * 1/2013 Molyneux ..... A43B 3/0005 73/862.381
2013/0086816 A1 * 4/2013 Johnson ..... A43C 1/00 36/83
2013/0091731 A1 * 4/2013 Wang ..... A43B 13/14 36/99
2013/0104429 A1 * 5/2013 Torres ..... A43B 3/0005 36/136
2013/0130843 A1 5/2013 Burroughs et al.
2013/0138029 A1 5/2013 Gerber et al.
2013/0211290 A1 8/2013 Lee
2013/0219754 A1 8/2013 Nowak et al.
2014/0026440 A1 1/2014 Beers et al.
2014/0057233 A1 2/2014 Morag et al.
2014/0068838 A1 3/2014 Beers et al.
2014/0070042 A1 3/2014 Beers et al.
2014/0082963 A1 3/2014 Beers
2014/0137434 A1 * 5/2014 Craig ..... A43B 1/04 36/54
2014/0196314 A1 7/2014 Beye et al.
2014/0196316 A1 7/2014 Follet
2014/0228987 A1 8/2014 Case, Jr. et al.
2014/0244009 A1 8/2014 Mestas
2014/0245638 A1 9/2014 Seamarks et al.
2014/0249660 A1 9/2014 Prstojevich
2014/0260677 A1 9/2014 Dojan et al.
2014/0277632 A1 * 9/2014 Walker ..... G01L 1/2206 700/91
2014/0330409 A1 11/2014 Case, Jr. et al.
2014/0338225 A1 11/2014 Bliss
2014/0358472 A1 12/2014 Goel et al.
2014/0360047 A1 12/2014 Beers et al.
2015/0047230 A1 * 2/2015 Beers ..... A43B 1/0018 36/102
2015/0059204 A1 3/2015 Alexander et al.
2015/0096204 A1 4/2015 Case, Jr.
2015/0104772 A1 4/2015 Goel et al.
2015/0289594 A1 * 10/2015 Rushbrook ..... A43C 11/22 36/50.1
2016/0143396 A1 5/2016 Beers
2016/0219985 A1 8/2016 Beers et al.
2018/0153260 A1 6/2018 Beers
2018/0228250 A1 8/2018 Beers et al.
2020/0221827 A1 7/2020 Beers et al.
2020/0315298 A1 10/2020 Beers et al.

FOREIGN PATENT DOCUMENTS

CN 2521934 Y 11/2002
CN 1387743 A 12/2002
CN 2534836 Y 2/2003
CN 1742516 A 3/2006
CN 1810172 A 8/2006
CN 2810253 Y 8/2006

(56) References Cited

FOREIGN PATENT DOCUMENTS

| | | | |
|---|---|---|---|
| CN | 2914720 | Y | 6/2007 |
| CN | 103776461 | A | 5/2014 |
| CN | 102715706 | B | 2/2015 |
| CN | 102726888 | B | 8/2015 |
| CN | 107847007 | A | 3/2018 |
| CN | 108495568 | A | 9/2018 |
| EP | 0056953 | A1 | 8/1982 |
| EP | 0056953 | A2 | 8/1982 |
| EP | 0121026 | A1 | 10/1984 |
| EP | 0534560 | A1 | 3/1993 |
| EP | 2253238 | | 11/2010 |
| EP | 2283276 | A1 | 2/2011 |
| EP | 2796064 | A1 | 10/2014 |
| EP | 2278896 | B1 | 1/2018 |
| EP | 2278897 | B1 | 5/2018 |
| EP | 2283276 | B1 | 5/2018 |
| FR | 2643794 | A1 | 9/1990 |
| JP | 6270802 | U | 5/1987 |
| JP | 62290402 | A | 12/1987 |
| JP | 0499502 | A | 3/1992 |
| JP | 3033166 | U | 1/1997 |
| JP | 10502261 | A | 3/1998 |
| JP | 10225305 | A | 8/1998 |
| JP | 2000014402 | A | 1/2000 |
| JP | 2001513379 | A | 9/2001 |
| JP | 200001441 | | 1/2002 |
| JP | 2002119498 | | 4/2002 |
| JP | 2002238611 | A | 8/2002 |
| JP | 3092657 | U | 3/2003 |
| JP | 2004222782 | A | 8/2004 |
| JP | 2005029168 | A | 2/2005 |
| JP | 2006288783 | A | 10/2006 |
| TW | M299404 | U | 10/2006 |
| WO | WO-9415494 | A1 | 7/1994 |
| WO | WO-0115559 | A1 | 3/2001 |
| WO | WO-2006050266 | A2 | 5/2006 |
| WO | WO-2006060057 | A2 | 6/2006 |
| WO | WO-2008101203 | A1 | 8/2008 |
| WO | WO-2009062030 | A1 | 5/2009 |
| WO | WO-2009134858 | A1 | 11/2009 |
| WO | WO-2009134864 | A3 | 11/2009 |
| WO | WO-2016191115 | A1 | 12/2016 |
| WO | WO-2017091769 | A1 | 6/2017 |
| WO | WO-2017091769 | A8 | 6/2017 |

OTHER PUBLICATIONS

"International Application Serial No. PCT/US2016/032251, Written Opinion dated Aug. 22, 2016", 8 pgs.
"International Application Serial No. PCT/US2016/032251, International Preliminary Report on Patentability dated Dec. 7, 2017", 10 pgs.
"U.S. Appl. No. 12/114,022, Non Final Office Action dated Jun. 15, 2011", 8 pgs.
"U.S. Appl. No. 12/114,022, Notice of Allowance dated Aug. 10, 2011", 5 pgs.
"U.S. Appl. No. 12/114,022, Response filed Jun. 3, 2011 to Restriction Requirement dated May 5, 2011", 13 pgs.
"U.S. Appl. No. 12/114,022, Response filed Jul. 25, 2011 to Non Final Office Action dated Jun. 15, 2011", 12 pgs.
"U.S. Appl. No. 12/114,022, Restriction Requirement dated May 5, 2011", 6 pgs.
"U.S. Appl. No. 12/369,400, 312 Amendment filed Sep. 30, 2011", 2 pgs.
"U.S. Appl. No. 12/369,400, Examiner Interview Summary dated Aug. 19, 2011", 3 pgs.
"U.S. Appl. No. 12/369,400, Non Final Office Action dated Jun. 15, 2011", 6 pgs.
"U.S. Appl. No. 12/369,400, Notice of Allowance dated Sep. 7, 2011", 5 pgs.
"U.S. Appl. No. 12/369,400, PTO Response to Rule 312 Communication dated Oct. 14, 2011", 2 pgs.
"U.S. Appl. No. 12/369,400, Response filed Aug. 24, 2011 to Non Final Office Action dated Jun. 15, 2011", 12 pgs.
"U.S. Appl. No. 12/369,410, Examiner Interview Summary dated Aug. 8, 2011", 3 pgs.
"U.S. Appl. No. 12/369,410, Non Final Office Action dated May 11, 2011", 11 pgs.
"U.S. Appl. No. 12/369,410, Notice of Allowance dated Sep. 12, 2011", 8 pgs.
"U.S. Appl. No. 12/369,410, Response filed Aug. 10, 2011 to Non Final Office Action dated May 11, 2011", 12 pgs.
"U.S. Appl. No. 13/236,221 , Non Final Office Action dated Feb. 7, 2013", 8 pgs.
"U.S. Appl. No. 13/236,221, Notice of Allowance dated May 14, 2013", 6 pgs.
"U.S. Appl. No. 13/236,221, Response filed May 7, 2013 to Non Final Office Action dated Feb. 7, 2013", 12 pgs.
"U.S. Appl. No. 13/243,236, Examiner Interview Summary dated May 9, 2013", 3 pgs.
"U.S. Appl. No. 13/243,236, Non Final Office Action dated Feb. 12, 2013", 8 pgs.
"U.S. Appl. No. 13/243,236, Notice of Allowance dated May 23, 2013", 6 pgs.
"U.S. Appl. No. 13/243,236, Response filed May 13, 2013 to Non Final Office Action dated Feb. 12, 2013", 12 pgs.
"U.S. Appl. No. 13/955,007, Non Final Office Action dated Dec. 26, 2013", 8 pgs.
"U.S. Appl. No. 13/955,007, Notice of Allowance dated May 1, 2015", 8 pgs.
"U.S. Appl. No. 13/955,007, Response filed Mar. 12, 2014 to Non Final Office Action dated Dec. 26, 2013", 12 pgs.
"U.S. Appl. No. 14/310,586, Advisory Action dated Jan. 23, 2015", 3 pgs.
"U.S. Appl. No. 14/310,586, Final Office Action dated Nov. 14, 2014", 9 pgs.
"U.S. Appl. No. 14/310,586, Non Final Office Action dated May 27, 2015", 9 pgs.
"U.S. Appl. No. 14/310,586, Notice of Allowance dated Dec. 9, 2015", 5 pgs.
"U.S. Appl. No. 14/310,586, Response filed Jan. 20, 2015 to Final Office Action dated Nov. 14, 2014", 7 pgs.
"U.S. Appl. No. 14/310,586, Response filed May 15, 2015 to Restriction Requirement dated Mar. 16, 2015", 3 pgs.
"U.S. Appl. No. 14/310,586, Response filed Nov. 23, 2015 to Non Final Office Action dated May 27, 2015", 10 pgs.
"U.S. Appl. No. 14/310,586, Restriction Requirement dated Mar. 16, 2015", 6 pgs.
"U.S. Appl. No. 14/950,785, Non Final Office Action dated Jul. 5, 2017", 8 pgs.
"U.S. Appl. No. 14/950,785, Notice of Allowance dated Oct. 26, 2017", 8 pgs.
"U.S. Appl. No. 14/950,785, Response filed Jun. 12, 2017 to Restriction Requirement dated Jan. 11, 2017", 6 pgs.
"U.S. Appl. No. 14/950,785, Response filed Oct. 5, 2017 to Non Final Office Action dated Jul. 5, 2017", 8 pgs.
"U.S. Appl. No. 14/950,785, Restriction Requirement dated Jan. 11, 2017", 4 pgs.
"U.S. Appl. No. 15/059,385, Non Final Office Action dated Jul. 6, 2017", 12 pgs.
"U.S. Appl. No. 15/059,385, Notice of Allowance dated Dec. 13, 2017", 7 pgs.
"U.S. Appl. No. 15/059,385, Response filed Jun. 16, 2017 to Restriction Requirement dated Jan. 17, 2017", 7 pgs.
"U.S. Appl. No. 15/059,385, Response filed Nov. 6, 2017 to Non Final Office Action dated Jul. 6, 2017", 10 pgs.
"U.S. Appl. No. 15/059,385, Restriction Requirement dated Jan. 17, 2017", 6 pgs.
"Chinese Application Serial No. 200980115809.6, Decision to Grant dated Oct. 31, 2012", with English Transation, 2 pgs.
"Chinese Application Serial No. 200980115809.6, Office Action dated May 21, 2012", with English translation of claims, 9 pgs.
"Chinese Application Serial No. 200980115809.6, Response filed Sep. 29, 2012 to Office Action dated May 21, 2012", with English translation of claims, 7 pgs.

(56) References Cited

OTHER PUBLICATIONS

"Chinese Application Serial No. 200980125209.8, Decision to Grant dated Jan. 28, 2014", with English Translation, with English Translation, 2 pgs.
"Chinese Application Serial No. 200980125209.8, Office Action dated Jun. 20, 2013", with English translation of claims, with English Translation, 21 pgs.
"Chinese Application Serial No. 200980125209.8, Response filed Nov. 5, 2013 to Office Action dated Jun. 20, 2013", with machine translation, 62 pgs.
"Chinese Application Serial No. 200980125531.0, Decision to Grant dated Feb. 13, 2014", English translation, 2 pgs.
"Chinese Application Serial No. 200980125531.0, Office Action dated Jan. 25, 2013", with English translation of claims, 8 pgs.
"Chinese Application Serial No. 200980125531.0, Office Action dated Jun. 1, 2012", with English translation of claims, 14 pgs.
"Chinese Application Serial No. 200980125531.0, Office Action dated Aug. 5, 2013", with English translation of claims, 12 pgs.
"Chinese Application Serial No. 200980125531.0, Response filed Apr. 9, 2013 to Office Action dated Jan. 25, 2013", with English translation of claims, 29 pgs.
"Chinese Application Serial No. 200980125531.0, Response filed Oct. 12, 2012 to Office Action dated Jun. 1, 2012", with English translation of claims, 14 pgs.
"Chinese Application Serial No. 200980125531.0, Response filed Nov. 5, 2013 to Office Action dated Aug. 5, 2013", with machine translation, 10 pgs.
"Chinese Application Serial No. 201210233338.2, Office Action dated May 6, 2014", W/English Translation, 18 pgs.
"Chinese Application Serial No. 201210233338.2, Office Action dated Dec. 31, 2014", W/English Translation, 7 pgs.
"Chinese Application Serial No. 201210233338.2, Response filed Sep. 22, 2014 to Office Action dated May 6, 2014", with English translation of claims, 8 pgs.
"Chinese Application Serial No. 20121023338.2, Response filed Mar. 16, 2015", with English translation, 3 pgs.
"Chinese Application Serial No. 201210234324.2, Decision To Grant dated Nov. 15, 2014", English translation, 2 pgs.
"Chinese Application Serial No. 201210234324.2, Office Action dated Mar. 24, 2014", with English translation of claims, 15 pgs.
"Chinese Application Serial No. 201210234324.2, Response filed Aug. 8, 2014 to Office Action dated Mar. 24, 2014", with English translation of claims, 28 pgs.
"European Application Serial No. 09739660.0, Extended European Search Report dated Nov. 28, 2013", 9 pgs.
"European Application Serial No. 09739660.0, Invitation Pursuant to Rule 62a(1) EPC and Rule 63(1) EPC dated Aug. 22, 2013", 3 pgs.
"European Application Serial No. 09739660.0, Response filed Feb. 20, 2014 to Extended European Search Report dated Nov. 28, 2013", 30 pgs.
"European Application Serial No. 09739660.0, Response filed Oct. 4, 2013", 1 pg.
"European Application Serial No. 09739662.6, Intention to Grant dated Jan. 5, 2018", 55 pgs.
"European Application Serial No. 09739662,6, Response filed Jul. 16, 2014 to Extended European Search Report dated Mar. 13, 2014", 19 pgs.
"European Application Serial No. 09739662.6, Extended European Search Report dated Mar. 13, 2014", 8 pgs.
"European Application Serial No. 09739666.7, Extended European Search Report dated Feb. 18, 2014", 6 pgs.
"European Application Serial No. 09739666.7, Response filed May 8, 2012", 1 pg.
"European Application Serial No. 09739666.7, Response filed May 9, 2014", 20 pgs.
"European Application Serial No. 14160429.8, Decision to grant dated Jan. 8, 2016", English translation, 2 pgs.
"European Application Serial No. 14160429.8, Extended European Search Report dated Sep. 30, 2014", 4 pgs.
"European Application Serial No. 14160429.8, Intention to grant dated Jul. 24, 2015", 6 pgs.
"European Application Serial No. 14160429.8, Response filed Apr. 24, 2015 to Extended European Search Report dated Sep. 30, 2014", 8 pgs.
"European Application Serial No. 14160429.8, Response filed Nov. 24, 2015", with machine translations, 16 pgs.
"International Application Serial No. PCT/US2009/042072, International Preliminary Report on Patentability dated Nov. 11, 2010", 10 pgs.
"International Application Serial No. PCT/US2009/042072, International Search Report dated Jul. 27, 2009", 2 pgs.
"International Application Serial No. PCT/US2009/042072, Written Opinion dated Feb. 14, 2012", 3 pgs.
"International Application Serial No. PCT/US2009/042072, Written Opinion dated Jul. 27, 2009", 8 pgs.
"International Application Serial No. PCT/US2009/042075, International Preliminary Report on Patentability dated Nov. 11, 2010", 7 pgs.
"International Application Serial No. PCT/US2009/042075, International Search Report dated Jul. 27, 2009", 2 pgs.
"International Application Serial No. PCT/US2009/042075, Written Opinion dated Jul. 27, 2009", 5 pgs.
"International Application Serial No. PCT/US2009/042081, International Preliminary Report on Patentability dated Mar. 15, 2012", 5 pgs.
"International Application Serial No. PCT/US2009/042081, International Search Report dated Feb. 14, 2012", 5 pgs.
"International Application Serial No. PCT/US2009/042081, Witten Opinion dated Feb. 14, 2012", 3 pgs.
"International Application Serial No. PCT/US2016/063670, International Search Report dated Mar. 17, 2017", 4 pgs.
"International Application Serial No. PCT/US2016/063670, Written Opinion dated Mar. 17, 2017", 9 pgs.
"Japanese Application Serial No. 2011-507603, Decision to Grant dated Jul. 2, 2013", with English Translation, 6 pgs.
"Japanese Application Serial No. 2011-507603, Office Action dated Mar. 12, 2013", with English translation of claims, with English Translation, 6 pgs.
"Japanese Application Serial No. 2011-507603, Response filed Jun. 3, 2013 to Office Action dated Mar. 12, 2013", 9 pgs.
"Japanese Application Serial No. 2011-507604, Decision to Grant dated Jan. 7, 2014", with English Translation, 6 pgs.
"Japanese Application Serial No. 2011-507604, Office Action dated Mar. 26, 2013", with English translation of claims, with English Translation, 4 pgs.
"Japanese Application Serial No. 2011-507604, Response filed Jun. 18, 2013 to Office Action dated Mar. 26, 2013", with English translation of claims, English Translation of Claims, 17 pgs.
"Japanese Application Serial No. 2011-507605, Decision to Grant dated Nov. 12, 2013", English translation, 6 pgs.
"Japanese Application Serial No. 2011-507605, Office Action dated May 14, 2013", with English translation of claims, with English Translation, 4 pgs.
"Japanese Application Serial No. 2011-507605, Office Action dated Sep. 10, 2013", with English translation of claims, with English Translation, 4 pgs.
"Japanese Application Serial No. 2011-507605, Response filed Aug. 8, 2013 to Office Action dated May 14, 2013", with English translation of claims, 14 pgs.
"Japanese Application Serial No. 2011-507605, Response filed Oct. 3, 2013 to Office Action dated Sep. 10, 2013", English translation of claims, 13 pgs.
U.S. Appl. No. 15/059,385 U.S. Pat. No. 9,943,139, filed Mar. 3, 2016, Automatic Lacing System.
"U.S. Appl. No. 15/953,621 Preliminary Amendment Filed Apr. 23, 2018", 7 pgs.
"U.S. Appl. No. 15/953,621, Restriction Requirement dated Oct. 8, 2019", 7 pgs.
"European Application Serial No. 16/28443.9, Communication Pursuant to Article 94(3) EPC dated Mar. 13, 2019", 7 pgs.

(56) References Cited

OTHER PUBLICATIONS

"European Application Serial No. 16728443.9, Response filed Jul. 27, 2018 to Communication Pursuant to Rules 161 and 162 EPC dated Jan. 17, 2018", 20 pgs.
"European Application Serial No. 16728443.9, Resposne filed Sep. 3, 2019 to Communication Pursuant to Article 94(3) EPC dated Mar. 13, 2019", 27 pgs.
"European Application Serial No. 18150821.9, Extended European Search Report dated Sep. 18, 2018", 7 pgs.
"European Application Serial No. 18150821.9, Response filed Apr. 17, 2019 to Extended European Search Report dated Sep. 18, 2018", 19 pgs.
"First appearance of bag at 7:24 in "Back to The Future, Part II" (Universal Pictures 1989)", You Tube, [Online]. Retrieved from the Internet: <URL: Back to The Future Part II (Universal Pictures 1989)>, (1989), 1 minute, 5 seconds.
"International Application Serial No. PCT/US2016/063670, International Preliminary Report on Patentability dated Jun. 7, 2018", 11 pgs.
"U.S. Appl. No. 15/953,621, Non Final Office Action dated Jan. 28, 2020", 11 pgs.
"U.S. Appl. No. 15/953,621, Response filed Jan. 6, 2020 to Restriction Requirement dated Oct. 8, 2019", 7 pgs.
"Chinese Application Serial No. 201680044192.3, Office Action dated Dec. 26, 2019", W/O English Translation, 8 pgs.
"European Application Serial No. 16728443.9, Communication Pursuant to Article 94(3) EPC dated Jan. 22, 2020", 5 pgs.
"U.S. Appl. No. 16/837,810, Preliminary Amendment filed Apr. 2, 2020", 6 pgs.
"U.S. Appl. No. 15/953,621, Response filed Apr. 28, 2020 to Non Final Office Action dated Jan. 28, 2020", 8 pgs.
"European Application Serial No. 16728443.9, Response filed Apr. 27, 2020 to Communication Pursuant to Article 94(3) EPC dated Jan. 22, 2020", 64 pgs.
"U.S. Appl. No. 15/953,621, Final Office Action dated May 11, 2020", 14 pgs.
"U.S. Appl. No. 15/953,621, Advisory Action dated Jul. 21, 2020", 3 pgs.
"U.S. Appl. No. 15/953,621, Examiner Interview Summary dated Jul. 30, 2020", 3 pgs.
"U.S. Appl. No. 15/953,621, Response filed Jul. 13, 2020 to Final Office Action dated May 11, 2020", 7 pgs.
"U.S. Appl. No. 15/953,621, Response filed Oct. 12, 2020 to Advisory Action dated Jul. 21, 2020", 7 pgs.
"Chinese Application Serial No. 201680044192.3, Office Action dated Sep. 15, 2020", w/o English Translation, 7 pgs.
"Chinese Application Serial No. 201680044192.3, Response filed Jul. 10, 2020 to Office Action dated Dec. 26, 2019", w/ English claims, 11 pgs.
"Chinese Application Serial No. 201680044192.3, Decision of Rejection dated Apr. 23, 2021", 5 pgs.
"U.S. Appl. No. 15/953,621, Final Office Action dated Dec. 22, 2020", 13 pgs.
"Chinese Application Serial No. 201680044192.3, Response filed Jan. 15, 2021 to Office Action dated Sep. 15, 2020", w English Claims, 15 pgs.

* cited by examiner

ARTICLE OF FOOTWEAR AND A METHOD OF ASSEMBLY OF THE ARTICLE OF FOOTWEAR

BACKGROUND

The present embodiments relate generally to articles of footwear and methods of manufacturing an article of footwear.

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper. Likewise, some articles of apparel may include various kinds of closure systems for adjusting the fit of the apparel.

SUMMARY

In one aspect, the present disclosure is directed to an article of footwear, comprising an upper and a sole structure, the upper comprising an inner void and an inner surface. The article of footwear also has at least one removable element, where the at least one removable element is configured to be removable and re-insertable after manufacture of the article of footwear. A portion of the at least one removable element is fixedly attached to a portion of the upper. Furthermore, one or more compartments are disposed within the article of footwear, including a first compartment, and the removal of the at least one removable element provides access to the first compartment.

In another aspect, the present disclosure is directed to a method of installing one or components in an article of footwear, the method comprising manufacturing the article of footwear with one or more compartments, including a first compartment, removing one or more inner lining materials associated with the article of footwear, and inserting one or more components into the article, including a first component. The method further includes installing the first component in the first compartment, and reinserting the one or more inner lining materials in the article of footwear.

In another aspect, the present disclosure is directed to an assembly system for installing components in an article of footwear, the assembly system comprising an article of footwear, where the article of footwear includes an upper and a sole structure. The sole structure includes a first compartment, and the upper includes a second compartment. There is a removable inner liner material associated with the upper, and at least two components, the at least two components including a first component and a second component. The first component is configured to be inserted into the first compartment and the second component is configured to be inserted into the second compartment. Furthermore, the removable inner liner material is configured to be reinsertable within the upper.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
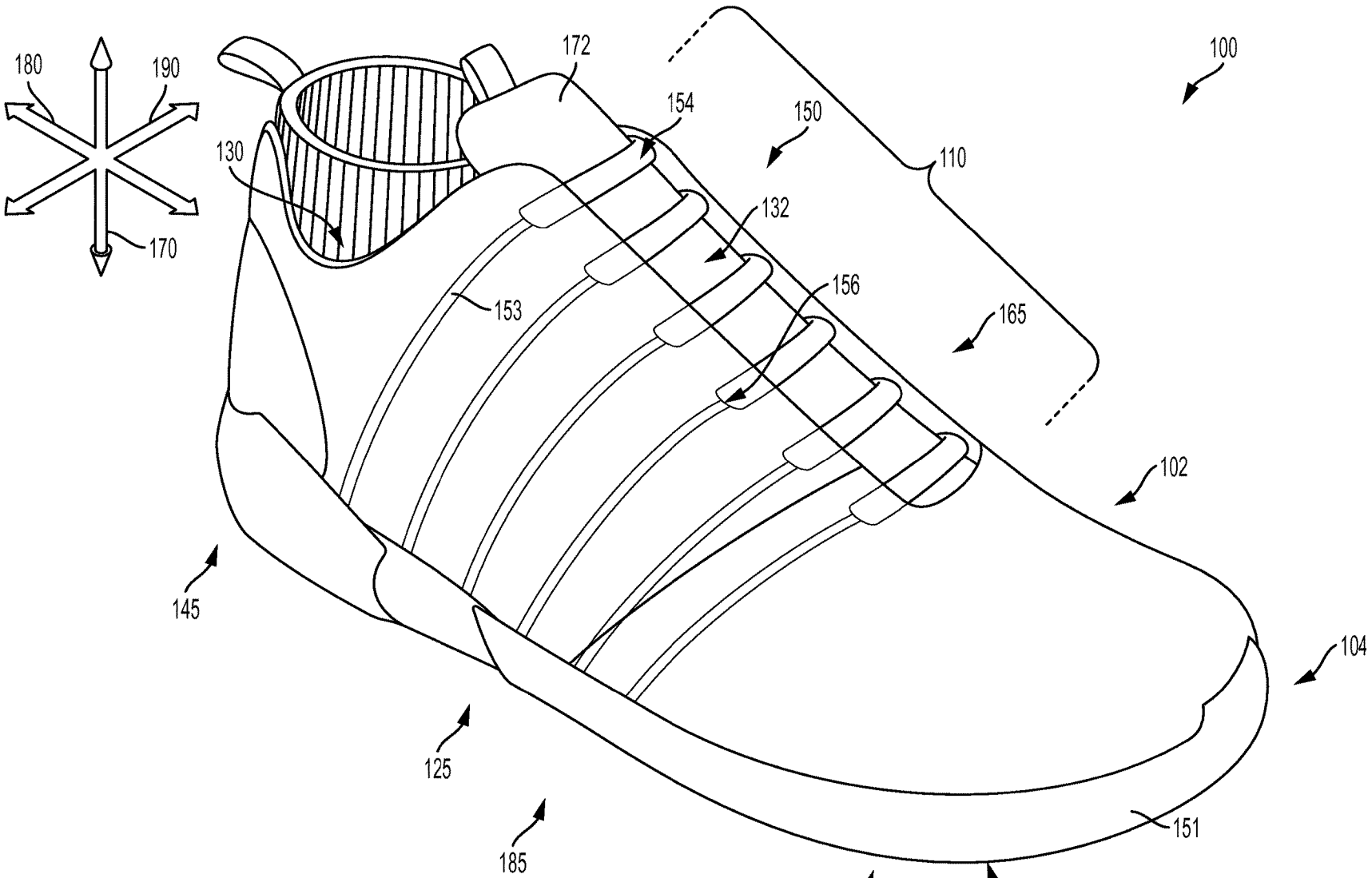
FIG. 1 is a schematic isometric side view of an embodiment of an article of footwear.

The following discussion and accompanying figures disclose articles of footwear and a method of assembly of an article of footwear. Concepts associated with the footwear disclosed herein may be applied to a variety of athletic footwear types, including running shoes, basketball shoes, soccer shoes, baseball shoes, football shoes, and golf shoes, for example. Accordingly, the concepts disclosed herein apply to a wide variety of footwear types.

To assist and clarify the subsequent description of various embodiments, various terms are defined herein. Unless otherwise indicated, the following definitions apply throughout this specification (including the claims). For consistency and convenience, directional adjectives are employed throughout this detailed description corresponding to the illustrated embodiments.

The term "longitudinal," as used throughout this detailed description and in the claims, refers to a direction extending a length of a component. For example, a longitudinal direction of an article of footwear extends between a forefoot region and a heel region of the article of footwear. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a component. In other words, the lateral direction may extend between a medial side and a lateral side of an article of footwear, with the lateral side of the article of footwear being the surface that faces away from the other foot, and the medial side being the surface that faces toward the other foot.

The term "side," as used in this specification and in the claims, refers to any portion of a component facing generally in a lateral, medial, forward, or rearward direction, as opposed to an upward or downward direction.

The term "vertical," as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

The "interior" of a shoe refers to space that is occupied by a wearer's foot when the shoe is worn. The "inner side" of a panel or other shoe element refers to the face of that panel or element that is (or will be) oriented toward the shoe interior in a completed shoe. The "outer side" or "exterior" of an element refers to the face of that element that is (or will be) oriented away from the shoe interior in the completed shoe. In some cases, the inner side of an element may have other elements between that inner side and the interior in the completed shoe. Similarly, an outer side of an element may have other elements between that outer side and the space external to the completed shoe. Further, the terms "inward" and "inwardly" shall refer to the direction toward the interior of the shoe, and the terms "outward" and "outwardly" shall refer to the direction toward the exterior of the shoe.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

In addition, for purposes of this disclosure, the term "fixedly attached" shall refer to two components joined in a manner such that the components may not be readily separated (for example, without destroying one or both of the components). Exemplary modalities of fixed attachment may include joining with permanent adhesive, rivets, stitches, nails, staples, welding or other thermal bonding, or other joining techniques. In addition, two components may be "fixedly attached" by virtue of being integrally formed, for example, in a molding process.

For purposes of this disclosure, the term "removably attached" or "removably inserted" shall refer to the joining of two components or a component and an element in a manner such that the two components are secured together, but may be readily detached from one another. Examples of removable attachment mechanisms may include hook and loop fasteners, friction fit connections, interference fit connections, threaded connectors, cam-locking connectors, compression of one material with another, and other such readily detachable connectors.

FIG. 1 illustrates a schematic isometric view of an embodiment of article 100 that is configured with a tensioning system 150. In the current embodiment, article 100, also referred to hereafter simply as article 100, is shown in the form of an athletic shoe, such as a running shoe. However, in other embodiments, tensioning system 150 may be used with any other kind of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments article 100 may be configured for use with various kinds of non-sports related footwear, including, but not limited to: slippers, sandals, high heeled footwear, loafers as well as any other kinds of footwear. As discussed in further detail below, a tensioning system may not be limited to footwear and in other embodiments a tensioning system and/or components associated with a tensioning system could be used with various kinds of apparel, including clothing, sportswear, sporting equipment and other kinds of apparel. In still other embodiments, a tensioning system may be used with braces, such as medical braces.

As noted above, for consistency and convenience, directional adjectives are employed throughout this detailed description. Article 100 may be divided into three general regions along a longitudinal axis 180: a forefoot region 105, a midfoot region 125, and a heel region 145. Forefoot region 105 generally includes portions of article 100 corresponding with the toes and the joints connecting the metatarsals with the phalanges. Midfoot region 125 generally includes portions of article 100 corresponding with an arch area of the foot. Heel region 145 generally corresponds with rear portions of the foot, including the calcaneus bone. Forefoot region 105, midfoot region 125, and heel region 145 are not intended to demarcate precise areas of article 100. Rather, forefoot region 105, midfoot region 125, and heel region 145 are intended to represent general relative areas of article 100 to aid in the following discussion. Since various features of article 100 extend beyond one region of article 100, the terms forefoot region 105, midfoot region 125, and heel region 145 apply not only to article 100, but also to the various features of article 100.

Referring to FIG. 1, for reference purposes, a lateral axis 190 of article 100, and any components related to article 100, may extend between a medial side 165 and a lateral side 185 of the foot. Additionally, in some embodiments, longitudinal axis 180 may extend from forefoot region 105 to a heel region 145. It will be understood that each of these directional adjectives may also be applied to individual components of an article of footwear, such as an upper and/or a sole member. In addition, a vertical axis 170 refers to the axis perpendicular to a horizontal surface defined by longitudinal axis 180 and lateral axis 190.

Article 100 may include upper 102 and sole structure 104. Generally, upper 102 may be any type of upper. In particular, upper 102 may have any design, shape, size and/or color. For example, in embodiments where article 100 is a basketball shoe, upper 102 could be a high top upper that is shaped to provide high support on an ankle. In embodiments where article 100 is a running shoe, upper 102 could be a low top upper.

As shown in FIG. 1, upper 102 may include one or more material elements (for example, meshes, textiles, foam, leather, and synthetic leather), which may be joined to define an interior void configured to receive a foot of a wearer. The material elements may be selected and arranged to impart properties such as light weight, durability, air-permeability, wear-resistance, flexibility, and comfort. Upper 102 may define an opening 130 through which a foot of a wearer may be received into the interior void.

At least a portion of sole structure 104 may be fixedly attached to upper 102 (for example, with adhesive, stitching, welding, or other suitable techniques) and may have a configuration that extends between upper 102 and the ground. Sole structure 104 may include provisions for attenuating ground reaction forces (that is, cushioning and stabilizing the foot during vertical and horizontal loading). In addition, sole structure 104 may be configured to provide traction, impart stability, and control or limit various foot motions, such as pronation, supination, or other motions.

In some embodiments, sole structure 104 may be configured to provide traction for article 100. In addition to providing traction, sole structure 104 may attenuate ground reaction forces when compressed between the foot and the ground during walking, running or other ambulatory activities. The configuration of sole structure 104 may vary significantly in different embodiments to include a variety of conventional or non-conventional structures. In some cases, the configuration of sole structure 104 can be configured according to one or more types of ground surfaces on which sole structure 104 may be used.

For example, the disclosed concepts may be applicable to footwear configured for use on any of a variety of surfaces, including indoor surfaces or outdoor surfaces. The configuration of sole structure 104 may vary based on the properties and conditions of the surfaces on which article 100 is anticipated to be used. For example, sole structure 104 may vary depending on whether the surface is harder or softer. In addition, sole structure 104 may be tailored for use in wet or dry conditions.

In some embodiments, sole structure 104 may be configured for a particularly specialized surface or condition. The proposed footwear upper construction may be applicable to any kind of footwear, such as basketball, soccer, football, and other athletic activities. Accordingly, in some embodiments, sole structure 104 may be configured to provide traction and stability on hard indoor surfaces (such as hardwood), soft, natural turf surfaces, or on hard, artificial turf surfaces. In some embodiments, sole structure 104 may be configured for use on multiple different surfaces.

As will be discussed further below, in different embodiments, sole structure 104 may include different components. For example, sole structure 104 may include an outsole, a midsole, a cushioning layer, and/or an insole. In addition, in some cases, sole structure 104 can include one or more cleat members or traction elements that are configured to increase traction with a ground surface.

In some embodiments, sole structure 104 may include multiple components, which may individually or collectively provide article 100 with a number of attributes, such as support, rigidity, flexibility, stability, cushioning, comfort, reduced weight, or other attributes. In some embodiments, sole structure 104 may include an insole/sockliner, a midsole 151, and a ground-contacting outer sole member ("outsole") 162, which may have an exposed, ground-contacting lower surface. In some cases, however, one or more of these components may be omitted. In one embodiment, sole structure 104 may comprise a sole plate, as will be further discussed below.

Furthermore, in some embodiments, an insole may be disposed in the void defined by upper 102. The insole may extend through each of forefoot region 105, midfoot region 125, and heel region 145, and between lateral side 185 and medial side 165 of article 100. The insole may be formed of a deformable (for example, compressible) material, such as polyurethane foams, or other polymer foam materials. Accordingly, the insole may, by virtue of its compressibility, provide cushioning, and may also conform to the foot in order to provide comfort, support, and stability.

Midsole 151 may be fixedly attached to a lower area of upper 102, for example, through stitching, adhesive bonding, thermal bonding (such as welding), or other techniques, or may be integral with upper 102. Midsole 151 may be formed from any suitable material having the properties described above, according to the activity for which article 100 is intended. In some embodiments, midsole 151 may include a foamed polymer material, such as polyurethane (PU), ethyl vinyl acetate (EVA), or any other suitable material that operates to attenuate ground reaction forces as sole structure 104 contacts the ground during walking, running, or other ambulatory activities.

Midsole 151 may extend through each of forefoot region 105, midfoot region 125, and heel region 145, and between lateral side 185 and medial side 165 of article 100. In some embodiments, portions of midsole 151 may be exposed around the periphery of article 100, as shown in FIG. 1. In other embodiments, midsole 151 may be completely covered by other elements, such as material layers from upper 102. For example, in some embodiments, midsole 151 and/or other portions of upper 102 may be disposed adjacent to a bootie (see FIGS. 3 and 4).

Furthermore, as shown in FIG. 1, article 100 may include a tongue 172, which may be provided near or along a throat opening 132. In some embodiments, tongue 172 may be provided in or near an instep region 110 of article 100. However, in other embodiments, tongue 172 may be disposed along other portions of an article of footwear, or an article may not include a tongue.

In addition, as noted above, in different embodiments, article 100 may include a tensioning system 150. Tensioning system 150 may comprise various components and systems for adjusting the size of an opening 130 leading to an interior void (see FIG. 2) and tightening (or loosening) upper 102 around a wearer's foot. Some examples of different tensioning systems that can be used are disclosed in Beers et al., U.S. Patent Publication Number 2014/0070042 published Mar. 13, 2014, (previously U.S. patent application Ser. No. 14/014,555, filed Aug. 30, 2013) and entitled "Motorized Tensioning System with Sensors" and Beers et al., U.S. Pat. No. 8,056,269, issued Nov. 15, 2011 (previously U.S. Patent Publication Number 2009/0272013, published Nov. 5, 2009) and entitled "Article of Footwear with Lighting System" the entire disclosures of which are incorporated herein by reference.

In some embodiments, tensioning system 150 may comprise one or more laces, as well as a motorized tensioning device. A lace may be configured to pass through various lacing guides 154, which may be further associated with the edges of a throat opening 132. In some cases, lacing guides 154 may provide a similar function to traditional eyelets on uppers. In particular, as a lace is pulled or tensioned, throat opening 132 may generally constrict so that upper 102 is tightened around a foot.

The arrangement of lacing guides 154 in FIG. 1 is only intended to be exemplary and it will be understood that other embodiments are not limited to a particular configuration for lacing guides 154. Furthermore, the particular types of lacing guides 154 illustrated in the embodiments are also exemplary and other embodiments may incorporate any other kinds of lacing guides or similar lacing provisions. In some other embodiments, for example, laces could be inserted through traditional eyelets. Some examples of lace guiding provisions that may be incorporated into the embodiments are disclosed in Cotterman et al., U.S. Patent Application Publication Number 2012/0000091, published Jan. 5, 2012 and entitled "Lace Guide," the disclosure of which is incorporated herein by reference in its entirety. Additional examples are disclosed in Goodman et al., U.S. Patent Application Publication Number 2011/0266384, published Nov. 3, 2011 and entitled "Reel Based Lacing System", the disclosure of which is incorporated herein by reference in its entirety. Still additional examples of lace guides are disclosed in Kerns et al., U.S. Patent Application Publication Number 2011/0225843, published Sep. 22, 2011 and entitled "Guides For Lacing Systems," the disclosure of which is incorporated herein by reference in its entirety.

A lace as used with article 100 may comprise any type of type of lacing material known in the art. Examples of laces that may be used include cables or fibers having a low modulus of elasticity as well as a high tensile strength. A lace may comprise a single strand of material, or can comprise multiple strands of material. An exemplary material for the lace is SPECTRA™, manufactured by Honeywell of Morris Township N.J., although other kinds of extended chain, high modulus polyethylene fiber materials can also be used as a lace. Still further exemplary properties of a lace can be found in the Reel Based Lacing Application mentioned above.

Thus, in some embodiments, a lace may be passed through lacing guides 154. In other embodiments, a lace may pass through internal channels 153 within upper 102 after entering channel openings 156 that are near lacing guides 154. In some embodiments, internal channels 153 extend around the sides of upper 102 and guide the lace towards a motorized tensioning device disposed in sole structure 104. In some cases, the motorized tensioning device may include provisions for receiving portions of a lace. In some cases, end portions of the lace can exit internal channels 153 of upper 102 and can pass through apertures in a housing unit that contains a motorized tensioning device.

In some embodiments, a motorized tensioning device may generally be configured to automatically apply tension to a lace for purposes of tightening and loosening upper 102. A motorized tensioning device may thus include provisions for winding a lace onto, and unwinding a lace from, a spool internal to the motorized tensioning device. Moreover, the provisions may include an electric motor that automatically winds and unwinds the spool in response to various inputs or controls.

Some embodiments may include one or more compartments disposed throughout various portions of article 100. For purposes of this disclosure, a compartment refers to a separate or distinct section or portion of article 100. In some embodiments, a compartment can include a sleeve-like region, a tunnel or tubing disposed within article 100, and/or a recess, cavity, pocket, chamber, slot, pouch, or other space configured to receive an object, element, or component. In some embodiments, during manufacture of article 100, one or more compartments can be included in article 100, as will be discussed below.

Figure 2:
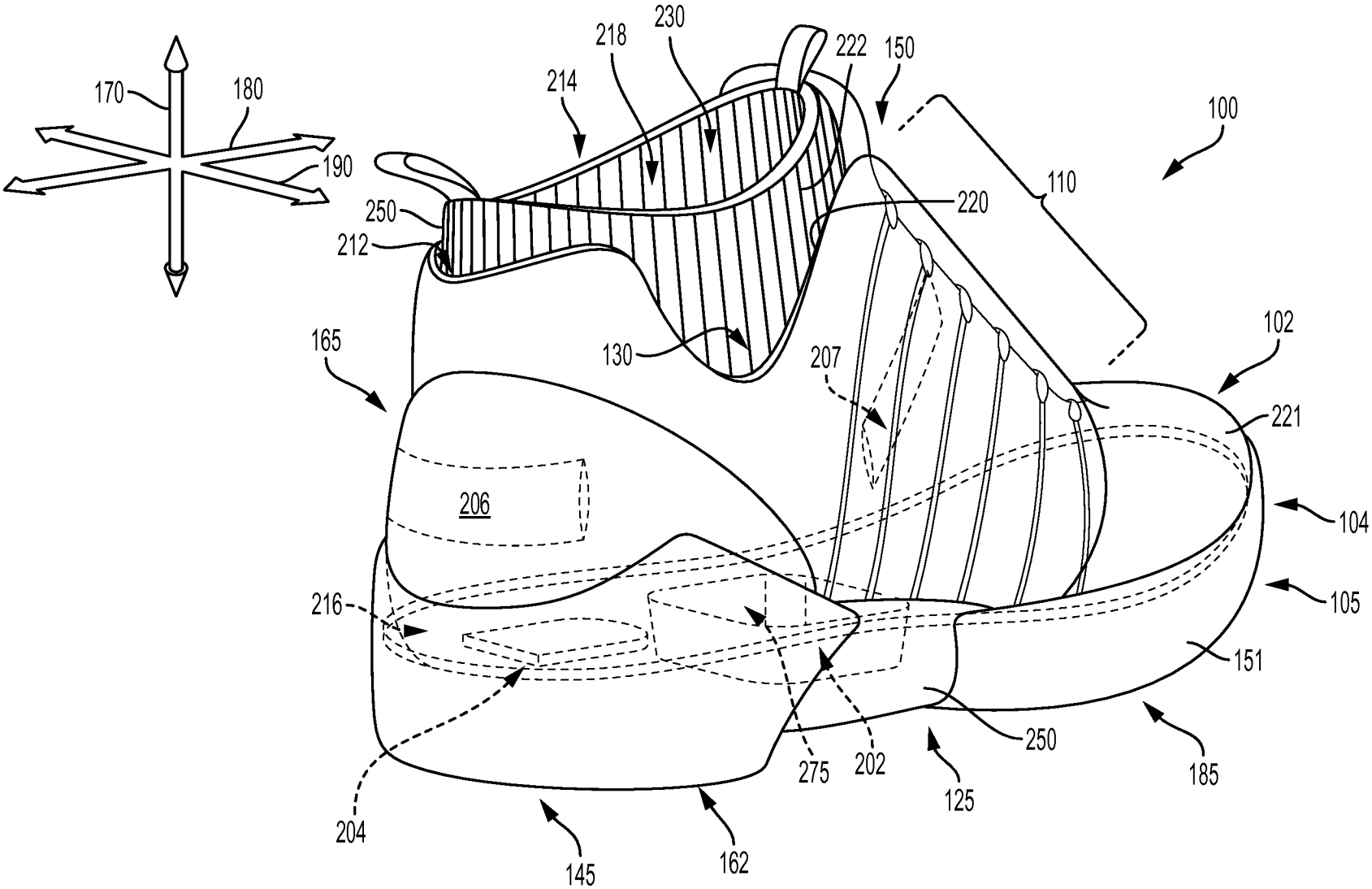
FIG. 2 is a schematic cutaway view of an embodiment of an article of footwear.

Referring to FIG. 2, an isometric side view of article 100 is depicted including an embodiment of a second compartment 204 and a third compartment 206, disposed near heel of article 100. FIG. 2 also provides a view of an embodiment of a first compartment 202 disposed in sole structure 104 and an embodiment of fourth compartment 207 disposed along a portion of upper 102.

In addition, as shown in FIG. 2, in some embodiments, upper 102 may include two sides. For example, there may be an outer surface 221 of upper 102, where outer surface 221 is disposed to form at least a portion of the external (outward facing) surface of upper 102. Furthermore, there may be an inner surface 220 of upper 102, where inner surface 220 is the surface of upper 102 that is facing toward a foot when a foot is disposed within an interior void 218. It should be understood that there may be one or more layers of material disposed between outer surface 121 and inner surface 122 in different embodiments.

In different embodiments, article 100 may include other elements. Referring to FIG. 2, article 100 includes a bootie 214 and a collar lining 212 that are disposed within upper 102. Bootie 214 and collar lining 212 may be removed, separated, or detached from article 100 in some embodiments. In one embodiment, the position or arrangement of bootie 214 and collar lining 212 may be adjusted within article 100. In some embodiments, bootie 214 and collar 212 or other elements may be moved (or removed) and then reinserted or replaced into article 100 (i.e., returned to their original arrangement within article 100) in different embodiments. This can occur after manufacture of article 100, as discussed further below. Bootie 214, collar lining 212, and/or other such adjustable inner lining materials or elements (such as a tongue) associated with the disclosed embodiments of article 100 may be referred to as "removable elements" for purposes of this description and the claims. Specific examples of removable elements such as bootie 214 and collar lining 212 will be discussed in further detail with respect to FIGS. 3-6 below.

In addition, article 100 can include a sole plate 250, which will be described with respect to FIGS. 8-10 below. In some embodiments, midsole 151 may be disposed adjacent to or receive sole plate 250. Furthermore, midsole 151 may be disposed adjacent to outsole 162.

In some embodiments, the various compartments may be designed, dimensioned, and/or configured to receive different types of components or elements. For example, first compartment 202, which is associated with sole plate 250, comprises a cavity 275, and is disposed underneath an optional insole 216 and bootie 214. First compartment 202 will be discussed in further detail with respect to FIGS. 8-10. In another example, second compartment 204 includes a relatively small recess within sole structure 104. Second compartment 204 may further be associated with a slot within heel region 145 of upper 102, which provides access to second compartment 204. Furthermore, third compartment 206 can comprise a sleeve-like region. In other words, third compartment 206 can be shaped as a generally tubular portion, with an end that can be opened. In FIG. 2, third compartment 206 is disposed within upper 102, adjacent to bootie 214 and collar lining 212. Second compartment 204 and third compartment 206 will be discussed in further detail with respect to FIGS. 11-14. Similarly, in another example, fourth compartment 207 comprises a sleeve-like region extending along medial side 165 of upper 102. In FIG. 2, fourth compartment 207 is disposed within upper 102, adjacent to bootie 214 and collar lining 212. Fourth compartment 207 will be discussed in further detail with respect to FIGS. 15-16. Thus, in different embodiments, article 100 may include areas that are disposed in different regions and can allow for the removable insertion, attachment, or installation of other objects, elements, or components.

Furthermore, it should be understood that the embodiments described herein with respect to the compartments in FIG. 2, and in further figures, may be applicable to articles that do not include a tensioning system. In other words, the method of manufacture where an article can include compartments, and/or the article which includes such compartments, may be utilized in any type or configuration of footwear or article of apparel.

Figure 3:
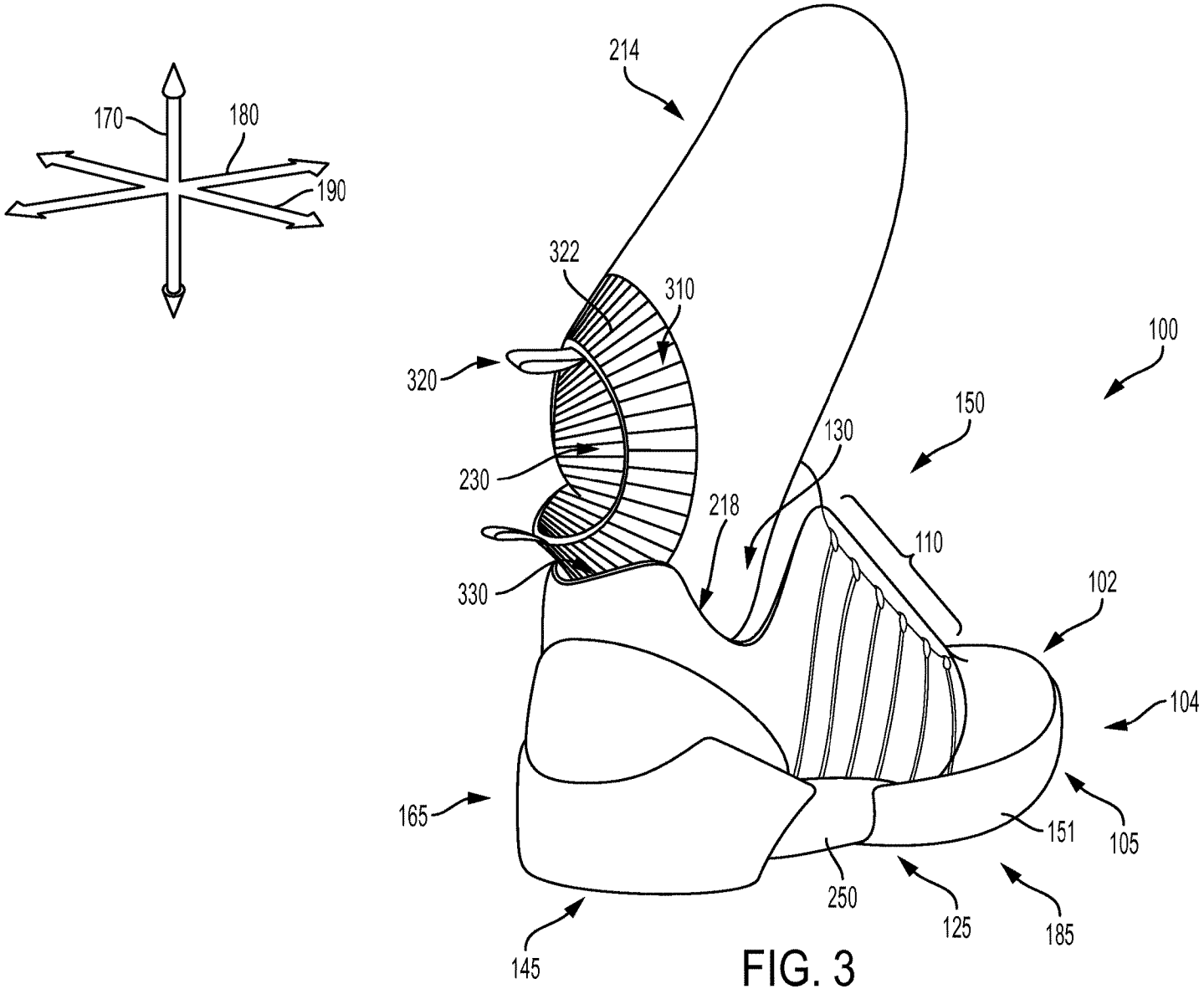
FIG. 3 is a schematic isometric side view of an embodiment of an article of footwear.
Figure 4:
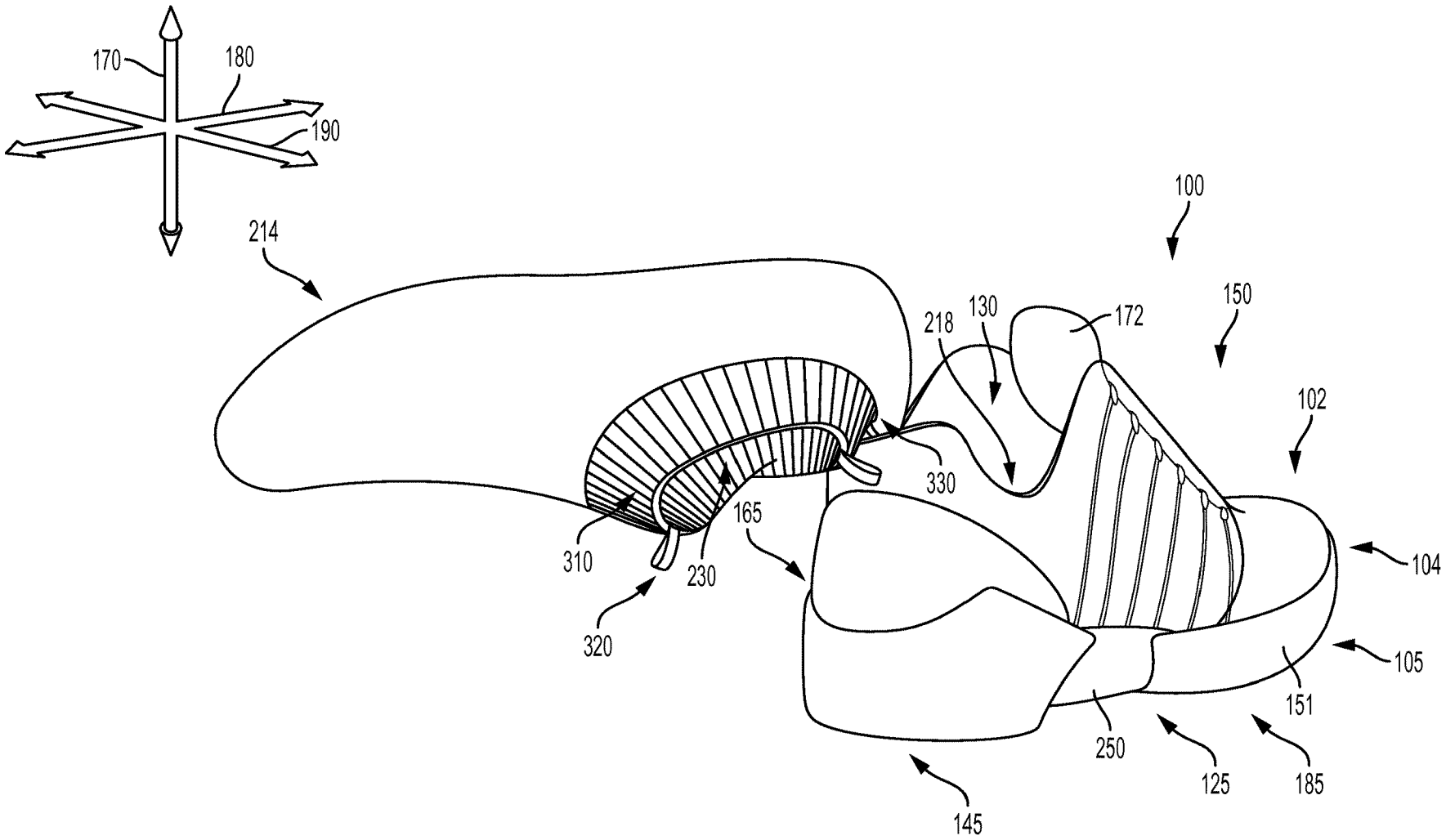
FIG. 4 is a schematic isometric side view of an embodiment of an article of footwear.

Referring to FIGS. 3 and 4, in some embodiments, removable bootie 214 may be provided within upper 102. The term "bootie" as used throughout this detailed description and in the claims refers to any component or layer that is generally configured to receive a foot. In some cases, booties could be configured for use with an article of footwear. A removable bootie, for example, could be inserted into an upper in order to receive the foot and provide an additional layer of cushioning, support, structure, protection as well as any other user comfort needs. In some cases, booties can be provided with various structures such as tongues, fastening systems, cushioning and supporting systems. In other cases, a portion of bootie 214 may be used to replace a tongue associated with an article of footwear. However, in another case, a tongue may be provided separately from bootie 214.

In one embodiment, bootie 214 can substantially surround or bound interior void 218 in article 100. In some embodiments, bootie 214 can be disposed adjacent to a substantial majority or all of inner surface 220 of upper 102. Furthermore, bootie 214 may also include bootie opening 230 for receiving a foot. In some embodiments, bootie opening 230 may correspond to or be aligned with opening 130 of upper 102 when bootie 214 is disposed and/or assembled in upper 102.

In some cases, when bootie 214 is disposed within upper 102, bootie 214 can partially or completely cover a wearer's foot. In other words, bootie 214 can comprise a resilient and/or stretchable material that can envelop the foot of a wearer. In some embodiments, bootie 214 is thin relative to the material of upper 102 and/or sole structure 104 components. The thinness of bootie 214 is such that assembled article 100 is not too bulky, and can allow bootie 214 to be substantially deformed or made compact if desired (e.g., for ease of removal from interior void 218 through opening 130). Bootie 214 can be made of any material, as discussed further below. In some embodiments, bootie 214 is of a construction which is sturdy enough to provide for foot protection, and support.

In different embodiments, bootie 214 may comprise various shapes or dimensions. For example, in FIG. 3, bootie 214 may be provided as a high-top bootie. In this embodiment, an ankle portion 322 of bootie 214 can be configured to sit relatively high on an ankle of a foot of a user. In another embodiment, bootie 214 may be provided as a low-top bootie. In this embodiment, an ankle portion of the bootie is configured to sit relatively low on an ankle of a foot of a user.

In different embodiments, bootie 214 may be joined to article 100 in different locations. In some embodiments, a portion of bootie 214 may be attached or joined to a portion of article 100. In one embodiment, a portion of bootie 214 may be joined to a portion of upper 102. In some embodiments, a portion of bootie 214 may be attached to a portion of upper 102 near the region associated with opening 130. Thus, in one embodiment, bootie 214 may include a first attachment region 330 for securing bootie 214 to a portion of article 100. First attachment region 330 may comprise stitching, welding, loops, buckles, adhesives, Velcro, hook and loop fasteners, snaps, zippers, straps and/or any other kinds of fasteners or means of attachment, etc. In other words, a variety of different securing means can be used, and are within the scope of the present disclosure. In some cases, although bootie 214 may not be lasted into the bottom of article 100 as midsole 151 may be, a wearer's body weight can hold the bootie relatively fixed in place with respect to other components of article 100 when article 100 is worn.

In FIGS. 3-4, first attachment region 330 is located in heel region 145, adjacent to opening 130, at the rear edge associated with a collar 310. In some embodiments, the location of first attachment region 330 may allow bootie 214 to be more readily moved and/or rotated relative to upper 102 while remaining anchored or tethered to article 100. Thus, in some embodiments, a portion of bootie 214 may be fixedly attached or joined to a portion of upper 102.

As indicated above, bootie 214 may be removable from interior void 218. For example, referring to FIGS. 3 and 4, bootie 214 is shown being pulled or removed from interior void 218 of upper 102. In FIG. 3, a substantial majority of bootie 214 has been pulled through opening 130, and is raised above article 100. In some embodiments, bootie 214 may include one or more loops 320 or tab portions for facilitating the removal and/or movement of bootie 214 (for example, by allowing a finger to be inserted into loops 320 and tugging or pulling at upper 102 via loops 320). In FIGS. 3 and 4, loops 320 are shown near heel region 145 of bootie 214, as well as near an edge of bootie opening 230.

In FIG. 4, bootie 214 is disposed in a generally "upside-down" position relative to its original position within upper 102. In other words, bootie 214 has been removed from interior void 218, and swiveled in a rearward direction. In embodiments where bootie 214 is secured to upper 102 via first attachment region 330, bootie 214 can be disposed adjacent to article 100 in a variety of shapes or orientations upon removal. It should be understood that in other embodiments, bootie 214 may be entirely removable, such that bootie 214 may be entirely separated from article 100 (i.e., such that there is no first attachment region 330). Furthermore, it should be understood that in other embodiments, article 100 may not include bootie 214 or the configuration of bootie 214 may differ from that illustrated herein.

Figure 5:
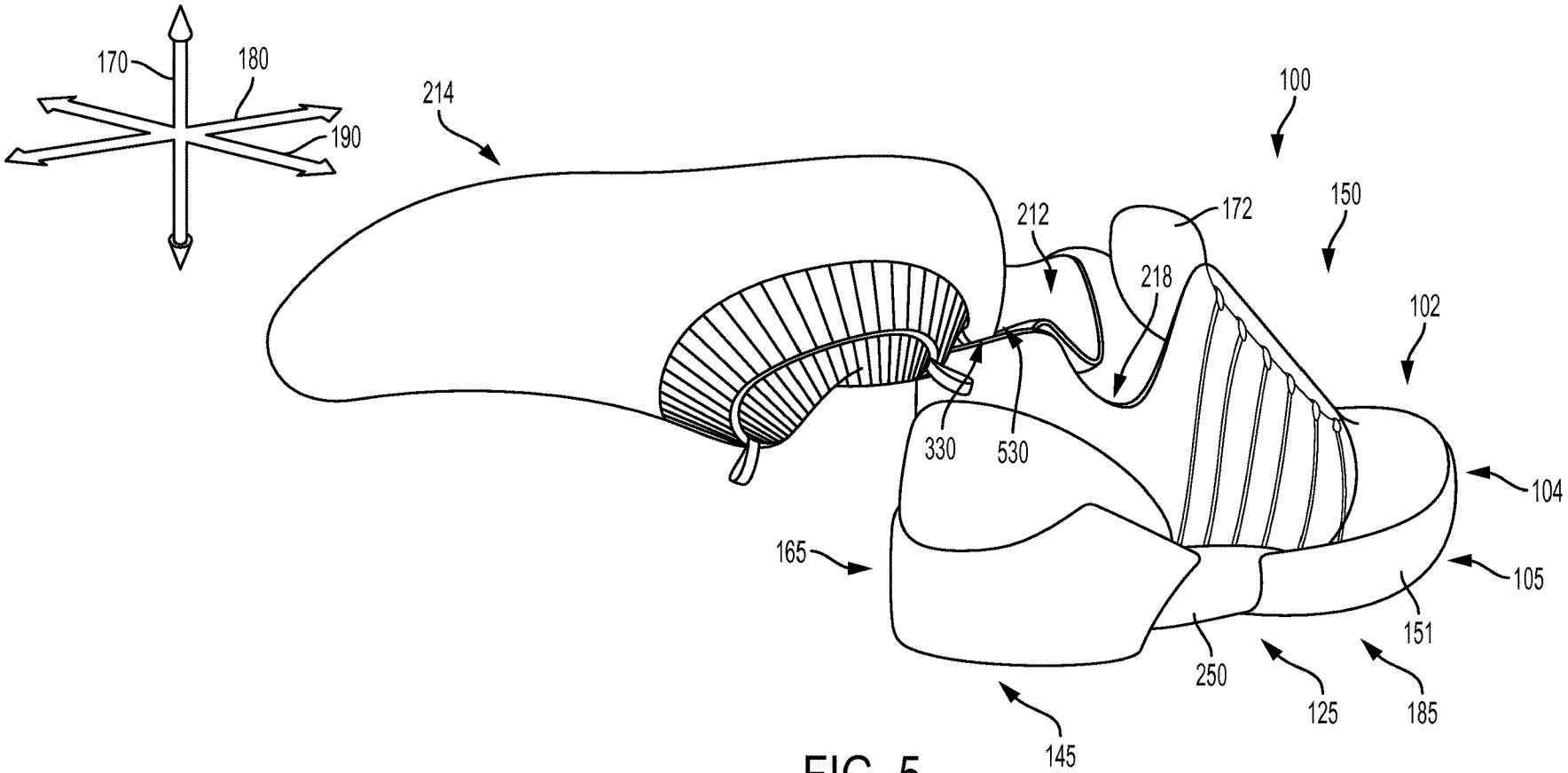
FIG. 5 is a schematic isometric view of an embodiment of an article of footwear.
Figure 6:
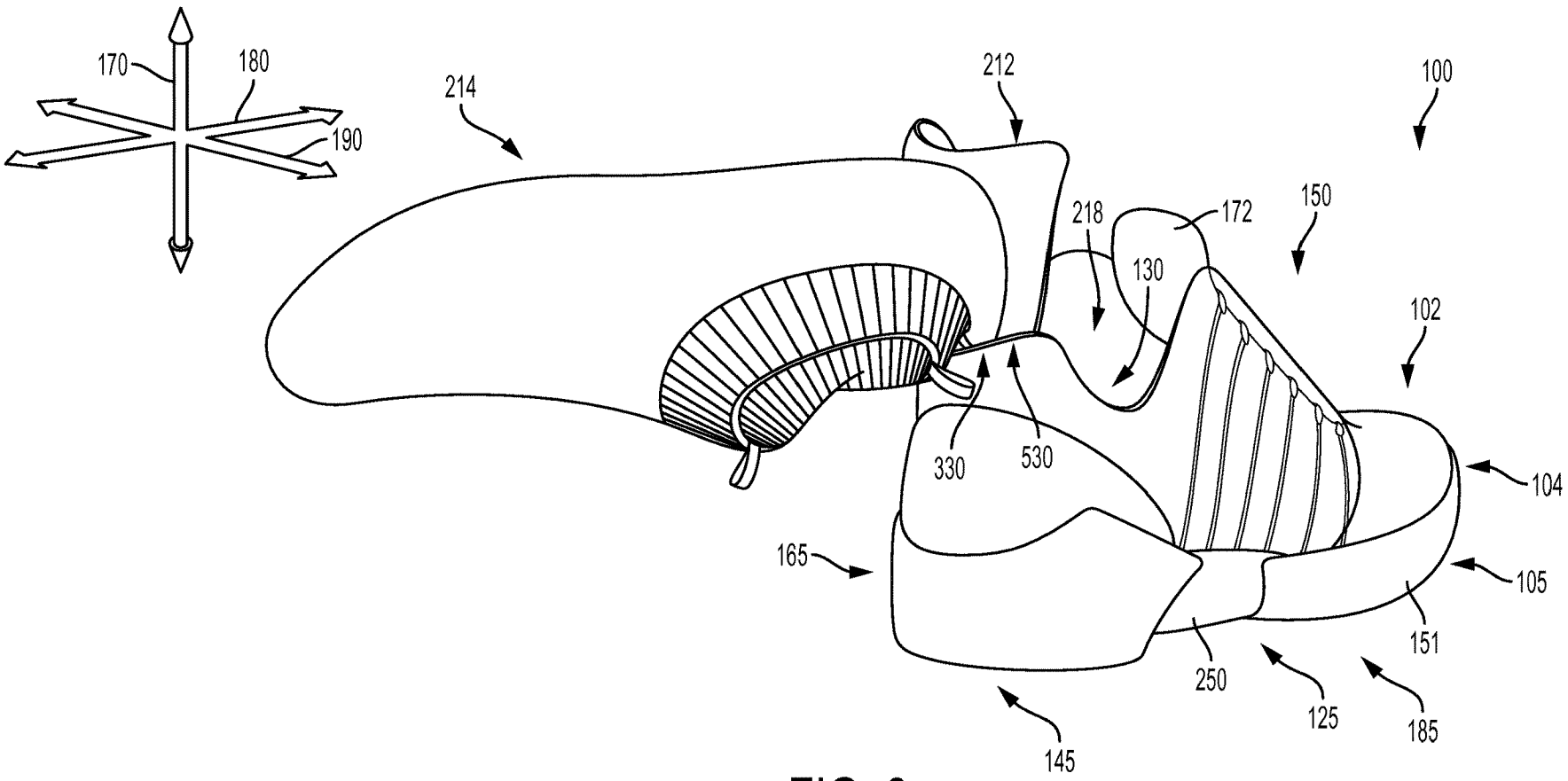
FIG. 6 is a schematic isometric side view of an embodiment of an article of footwear.

Referring to FIGS. 5 and 6, in some embodiments, removable collar lining 212 may be provided within upper 102. The term "collar lining" as used throughout this detailed description and in the claims refers to any component or fabric that is generally configured to be associated with heel region 145 of upper 102. A removable collar lining, for example, could be inserted into an upper in order to receive a foot and provide an additional layer of cushioning, support, structure, protection as well as any other user comfort needs.

In some embodiments, collar lining 212 can be disposed within interior void 218 of upper 102. In one embodiment, collar lining 212 can be associated with or disposed adjacent to a substantial majority of inner surface 220 of heel region 145 of upper 102.

In some embodiments, collar lining 212 is thin relative to the material of upper 102 and/or sole structure 104 components. The thinness of collar lining 212 is such that assembled article 100 is not too bulky, and can allow collar lining 212 to be substantially deformed or made compact if desired (e.g., for ease of removal from interior void 218 through opening 130). Collar lining 212 can be made of any material, as discussed below. In some embodiments, collar lining 212 is of a construction which is sturdy enough to provide for foot protection, and support. In some cases, collar lining 212 can be associated with or include cushioned regions that can provide additional support, comfort, and/or cushioning to a foot.

In different embodiments, collar lining 212 may comprise various shapes or dimensions. For example, in FIG. 5, collar lining 212 may be provided as a substantially flat or two-dimensional material or structure. The term "two-dimensional" as used throughout this detailed description and in the claims refers to any generally flat material exhibiting a length and width that are substantially greater than a thickness of the material. Although two-dimensional materials may have smooth or generally untextured surfaces, some two-dimensional materials will exhibit textures or other surface characteristics, such as dimpling, protrusions, ribs, or various patterns, for example. In other embodiments, the geometry of collar lining 212 could vary and could include various contours or features associated with parts of a foot, for example, an ankle region and/or heel region of a foot. In one embodiment, collar lining 212 may be disposed in such a manner so as to contact the region of interior void 218 of upper 102 that is most rear of article 100. In some embodiments, collar lining 212 may be disposed along or lie against at least a portion of inner surface 220 of upper 102 material in heel region 145 when collar lining 212 is in its assembled configuration within upper 102.

In different embodiments, collar lining 212 may be joined to article 100 in different locations. In some embodiments, a portion of collar lining 212 may be attached or joined to a portion of article 100. In one embodiment, a portion of collar lining 212 may be joined to a portion of upper 102. In some embodiments, a portion of collar lining 212 may be attached to a portion of upper 102 near the region and/or perimeter (border) associated with opening 130. In one embodiment, collar lining 212 may be attached along a continuous or substantially continuous region extending along or adjacent to a portion of collar 310. Thus, in one embodiment, collar lining 212 may include a second attachment region 530 for securing collar lining 212 to a portion of article 100. Second attachment region 530 may comprise stitching, welding, loops, buckles, adhesives, Velcro, hook and loop fasteners, snaps, zippers, straps and/or any other kinds of fasteners or means of attachment, etc. In other words, a variety of different securing means can be used, and are within the scope of the present disclosure. In some cases, although collar lining 212 may not be lasted into article 100, a wearer's body weight (specifically, at least the portion of a wearer's foot associated with the heel) can hold collar lining 212 relatively taut when article 100 is worn.

In FIGS. 5-6, second attachment region 530 is located in heel region 145, adjacent to opening 130, at the rear edge associated with collar 310. In some embodiments, the location of second attachment region 530 may allow collar lining 212 to be more readily moved and/or rotated relative to upper 102 while remaining anchored or tethered to article 100. Thus, in some embodiments, a portion of collar lining 212 may be fixedly attached or joined to a portion of upper 102. In one embodiment, second attachment region 530 and first attachment region 330 (shown in FIG. 3) may be substantially similar or joined.

As indicated above, collar lining 212 may be removable from interior void 218. For example, referring to FIGS. 5 and 6, collar lining 212 is shown being pulled or removed from interior void 218 of upper 102. In FIG. 5, a portion of collar lining 212 has been pulled up from the rear "wall" of upper 102. In some embodiments, collar lining 212 may include provisions for facilitating the removal and/or movement of collar lining 212, including but not limited to a tab or a loop.

In FIG. 6, collar lining 212 is disposed in a generally "inside-out" position relative to its original position within upper 102. In other words, collar lining 212 has been removed from interior void 218, and swiveled in a rearward direction along second attachment region 530. In embodiments where collar lining 212 is secured to upper 102 via second attachment region 530, collar lining 212 can be disposed adjacent to article 100 in a variety of shapes or orientations upon removal. It should be understood that in other embodiments, collar lining 212 may be entirely removable, such that collar lining 212 may be entirely separated from article 100 (i.e., such that there is no second attachment region 530). Furthermore, it should be understood that in other embodiments, article 100 may not include collar lining 212 or the configuration of collar lining 212 may differ from that illustrated herein. In some embodiments, the removal of collar lining 212 may expose access regions within article 100 to one or more compartments 202.

Thus, in some embodiments, different elements, layers, or components of article 100 may be readily moved or removed from article 100. In one embodiment, bootie 214 and/or collar lining 212 can be detached from their assembled position (as shown in FIG. 1) and removed or displaced. In one embodiment, the displacement of bootie 214, collar lining 212, and/or other removable elements (for example, a tongue) can expose different areas within interior void 218. In some cases, this can facilitate access to various portions or compartments disposed throughout article 100, as will be discussed below.

In different embodiments, it should be understood that the materials utilized in constructing various components and structures may vary. For example, a base layer or other portion for bootie 214 or collar lining 212 could be constructed of any kind of material, including but not limited to various kinds of textiles. Textiles for purposes of this disclosure are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a woven fabric. The textiles may incorporate fibers that are arranged to impart one-directional stretch or multi-directional stretch, and the textiles may include coatings that form a breathable and water-resistant barrier, for example. Examples of textile materials that could be used include, but are not limited to: animal textiles, such as wools and silks, plant textiles, such as cotton, flax, and lyocell, synthetic textiles such as polyester, aramid, acrylic, nylon, spandex, olefin fiber, ingeo, lurex and carbon fibers. In other embodiments, materials used for making the base layer of a bootie could include non-woven fabrics, flexible materials, polymer layers, natural leathers, synthetic leathers as well as any other materials. In some cases, polymer sheets could be used that may be extruded, rolled, or otherwise formed from a polymer material to exhibit a generally flat aspect. Bootie or collar lining materials may also encompass laminated or otherwise layered materials that include two or more layers of textiles, polymer sheets, or combinations of textiles and polymer sheets.

Figure 7:
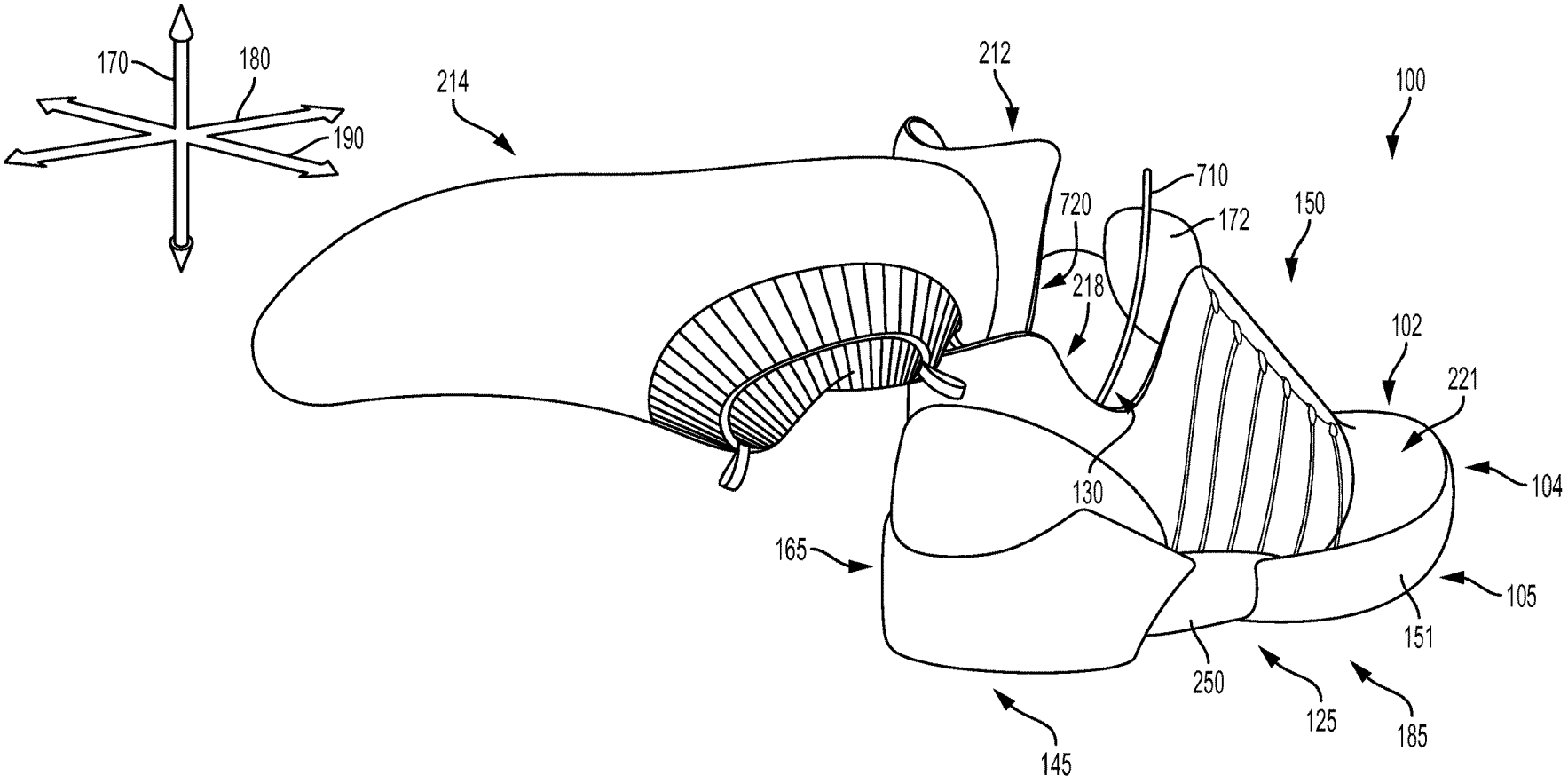
FIG. 7 is a schematic isometric side view of an embodiment of an article of footwear.

Referring now to FIG. 7, an embodiment of article 100 with bootie 214 removed from interior void 218 as well as collar lining 212 removed interior void 218 is shown. As noted previously, the removal of certain elements of article 100 may facilitate access to different portions or sections within article 100.

In some embodiments, during manufacture of article 100, one or more portions of article 100 may include connecting element 710. In some embodiments, connecting element 710 (such as wiring, cables, leads, cords, filaments or any other type of mechanical and/or electrical connector) may be disposed, incorporated, or integrated into article 100. In one embodiment, connecting element 710 can be disposed or installed in article 100 during the manufacturing process of the article of footwear. For example, in FIG. 7, connecting element 710 comprise a portion of wire extending from the region associated with sole structure 104, and upward along a sidewall 720 of upper 102. In one embodiment, the wire may be disposed to extend between layers of upper 102. In other words, in some embodiments, portions of upper 102 may comprise multiple layers, and connecting element 710 may be laid within or between two or more layers of upper 102. For example, connecting element 710 may be disposed between a first layer and a second layer of upper 102. In other embodiments, connecting element 710 may be stitched, molded, bonded, or otherwise fixedly or removably attached to article 100 during manufacture. In another embodiment, one or more connecting element 710 may be incorporated post-manufacture. However, article 100 may include a compartment for receiving connecting element 710 in some embodiments where connecting element 710 are inserted after manufacture of article 100. It should be understood that in different embodiments, article 100 may not include any connecting element 710.

In FIG. 7, a portion of connecting element 710 has been removed from interior void 218 of upper 102. In some embodiments, some or all portions of connecting element 710 may be readily moved within or removed from article 100 to facilitate any insertion or connection of article 100 to one or more components. In one embodiment, some or all portions of connecting element 710 may be fully or partially detached from their position in the manufactured article.

Figure 8:
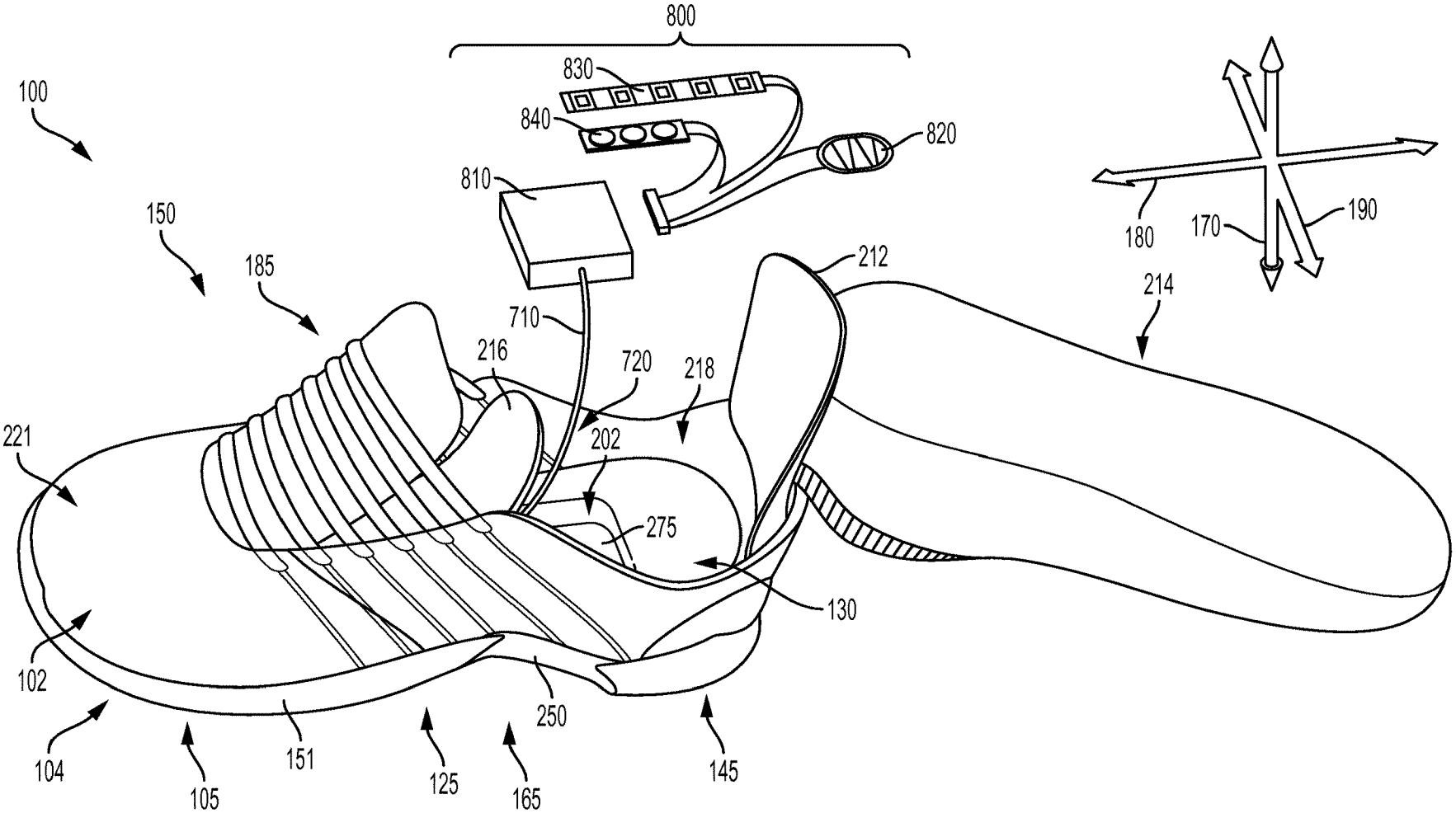
FIG. 8 is a schematic isometric view of an embodiment of some insertable components and an article of footwear.

Referring now to FIG. 8, an embodiment of article 100 with bootie 214 removed from interior void 218 as well as collar lining 212 removed interior void 218 is shown. Furthermore, to provide reader with an improved view of sole plate 250, optional insole 216 is raised to uncover a portion of sole plate 250 (sole plate 250 will be discussed further with respect to FIGS. 9-10 below). In FIG. 8, several components 800 are also illustrated adjacent to article 100. As noted above, one or more components 800 may be installed in article 100. In different embodiments, installation of components 800 may occur after the initial manufacture of article 100, as will be discussed further below.

Referring to FIG. 8, some examples of components 800, including a first component 810, a second component 820, a third component 830, and a fourth component 840 are depicted. In different embodiments, there may be a fewer or a greater number of components. In some embodiments, one component may be substantially similar to another component. However, in other embodiments, each component may be different from another component.

In one embodiment, one or more components 800 may be configured to provide various functions or features to article 100. For example, in FIG. 8, first component 810 comprises a housing unit, second component 820 comprises a sensor, third component 830 comprises an LED panel, and fourth component 840 comprises a control panel (here, a button board). In other embodiments, different mechanical or electrical components may be included, such as circuitry, textiles, or other materials. It should be understood that while two or more components may be connected or attached to one another, or share a common port (as seen with second component 820, third component 830, and fourth component 840 in the embodiment of FIG. 8), in other embodiments, any two components could be separate or disconnected from one another.

As noted above, article 100 may be manufactured to accommodate one or more components 800 in a manner that allows ready and secure incorporation of components 800 post manufacture. In other words, article 100 may include one or more compartments for receiving components 800. Thus, as an example, in the embodiments illustrated in FIGS. 2 and 8, article 100 may be manufactured such that first compartment 202 is configured to receive first component 810, second compartment 204 is configured to receive second component 820, third compartment 206 is configured to receive third component 830, and fourth compartment 207 is configured to receive fourth component 840.

Figure 9:
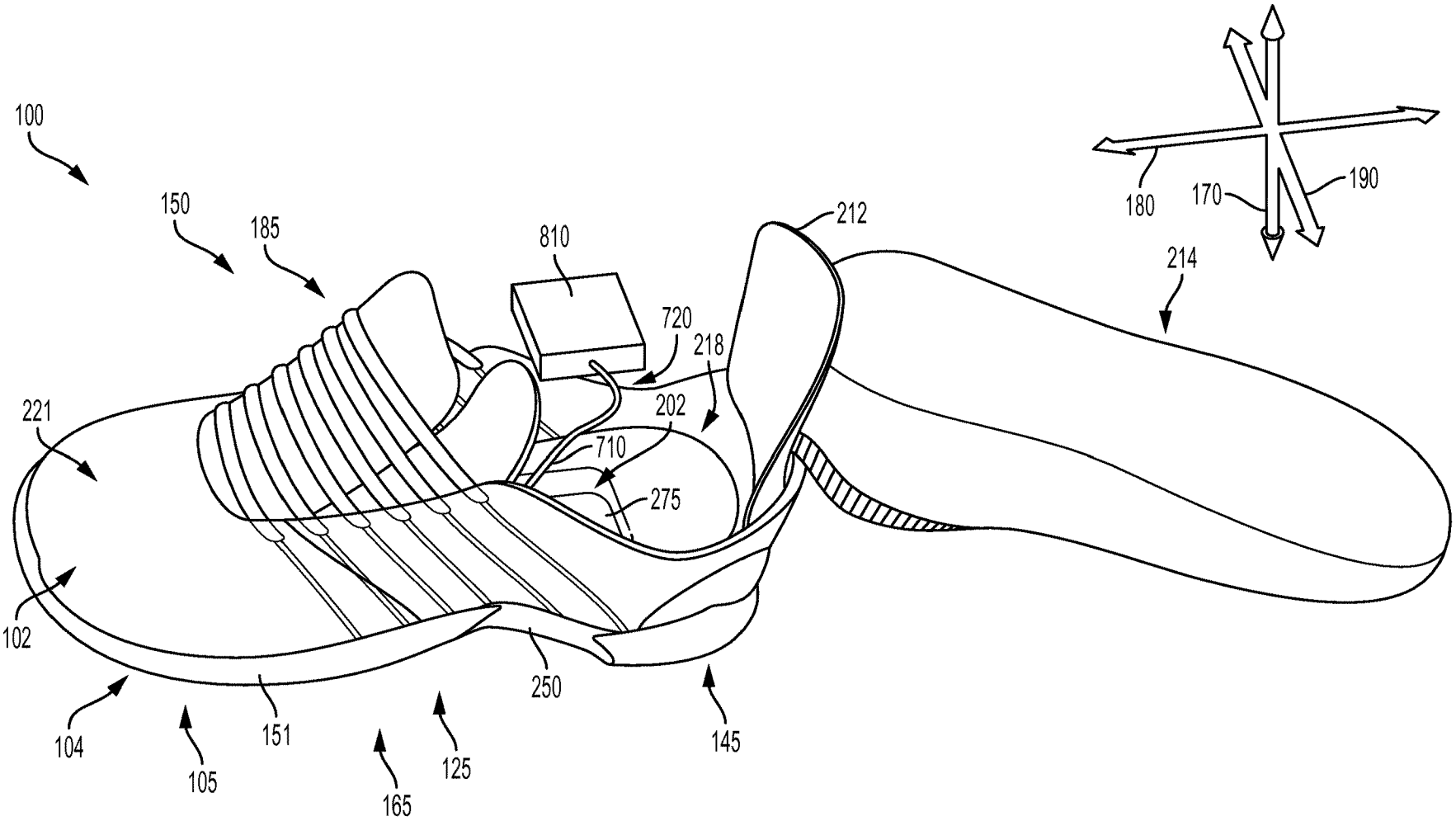
FIG. 9 is a schematic isometric view of an embodiment of a sole plate and a component.
Figure 10:
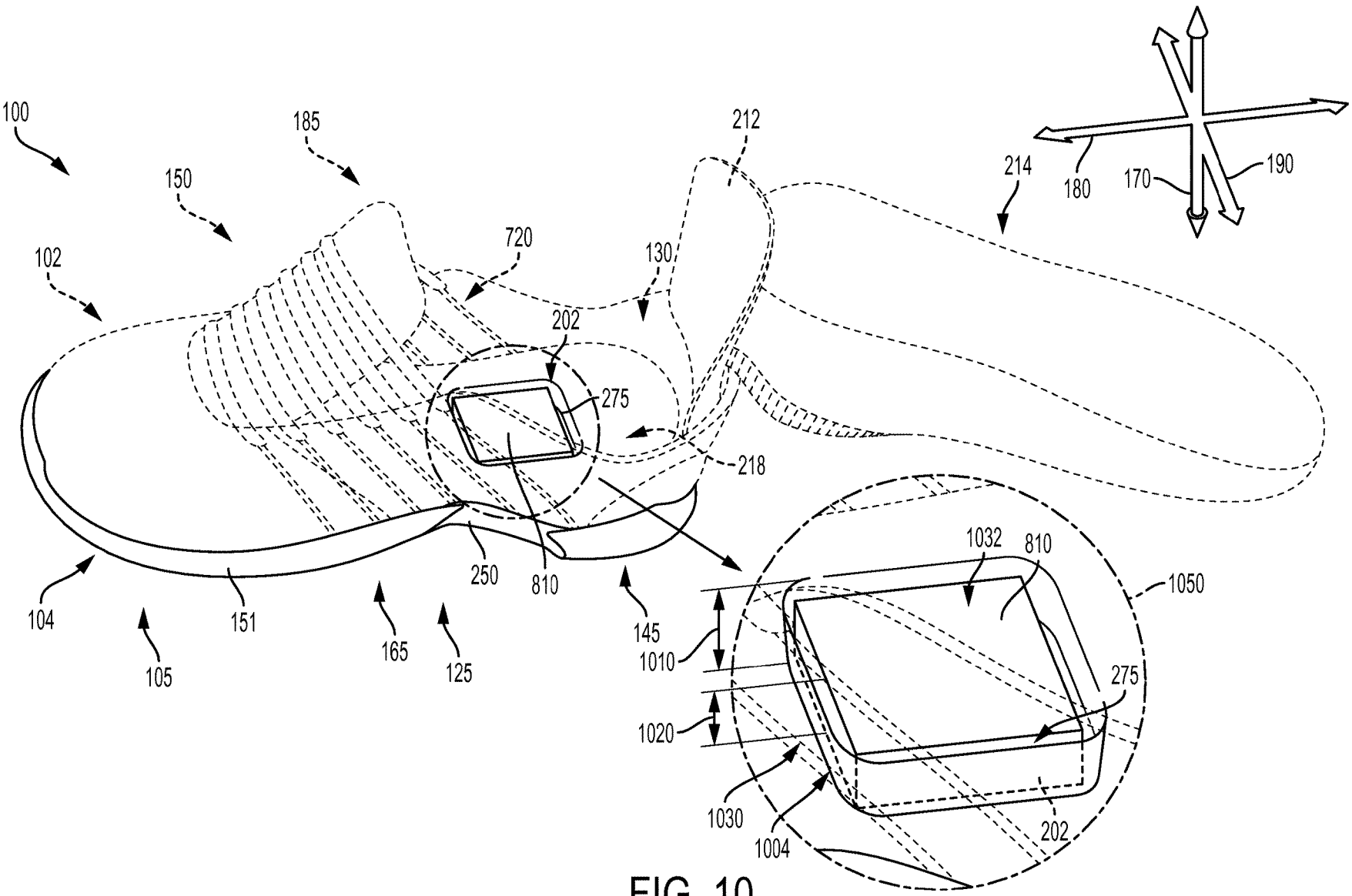
FIG. 10 is a schematic isometric view of an embodiment of a sole plate and a component.

To better illustrate the incorporation of various components with article 100, FIGS. 9-16 provide a series of figures depicting different embodiments of the insertion and installation of components 800 of FIG. 8. Referring to FIG. 9, first component 810, comprising a housing unit, is shown adjacent to article 100. In some embodiments, the housing unit may include various mechanisms or components that can be utilized in tensioning system 150 (see FIG. 1). In some cases, the housing unit may include a motorized tensioning device (see discussion above with respect to FIG. 1). For example, within the interior of first component 810 there may be a battery (or other power source), circuitry (or other control mechanism), spools, gears, a motor, light sources, and/or other mechanisms. However, in other embodiments, first component 810 may comprise any desired object or element for insertion into article 100. The housing unit may have different dimensions and/or shapes in different embodiments. In FIG. 9, first component 810 has a substantially three-dimensional rectangular shape.

In FIG. 9, the portion of connecting element 710 identified in FIG. 7 is shown as it contacts first component 810. In some embodiments, first component 810 may include a port or other accommodation for connecting with connecting element 710. In FIGS. 8 and 9, first component 810 is shown as it is being secured to a portion of connecting element 710.

In some embodiments, after a connection has occurred with connecting element 710, it may be desired to install first component 810 in article 100. However, it should be understood that installation of first component 810 may also occur without any prior (or subsequent) connection to an element of article 100. Referring to FIG. 10, a view of interior void 218 in upper 102 is depicted. The optional insole has been removed in this illustration to reveal a portion of sole plate 250. As noted earlier, in some embodiments, sole plate 250 may include a region configured to receive or accommodate first component 810, here identified as first compartment 202.

As best depicted in a magnified view 1050, first compartment 202 may comprise a cavity 275 in sole plate 250. Cavity 275 may be bounded by one or more sidewalls that form a region with an average depth 1010 in sole plate 250. In some embodiments, the dimensions of cavity 275 may be designed or configured for secure and/or snug receipt of the housing unit of first component 810. In FIG. 10, cavity 275 includes depth 1010 greater than a thickness 1020 of the housing unit comprising first component 810. Furthermore, in some cases, a first area associated with a first side 1032 of first component 810 may be less than a second area associated with a base 1004 of cavity 275. In other words, cavity 275 may be dimensioned to at least partially encompass or hold first component 810. In some embodiments, for example, the second area of the base may be slightly larger than the first area of first side 1032, such that a substantially snug fit is formed between first component 810 and first compartment 202. However, in other embodiments, dimensions of either first component 810 or first compartment 202 may differ such that one is substantially different from the other.

Thus, in some embodiments, first component 810 may be easily deposited or inserted into cavity 275 of sole plate 250 without requiring the removal of sole plate 250 from article 100. In other embodiments, however, it may be desirable to remove sole plate 250 prior to installation of first component 810. In addition, in some embodiments, other insulation or securing materials may be inserted into cavity 275 to further stabilize first component 810 if desired.

Once first component 810 has been inserted, insole 216 may be replaced. Furthermore, if no other additional components are desired in article 100, bootie 214 and/or collar lining 212 or other removable elements may be returned to interior void 218 (see FIG. 18), which can substantially complete the installation process in one embodiment. However, in other embodiments, additional or different components may be incorporated, as discussed below.

Figure 11:
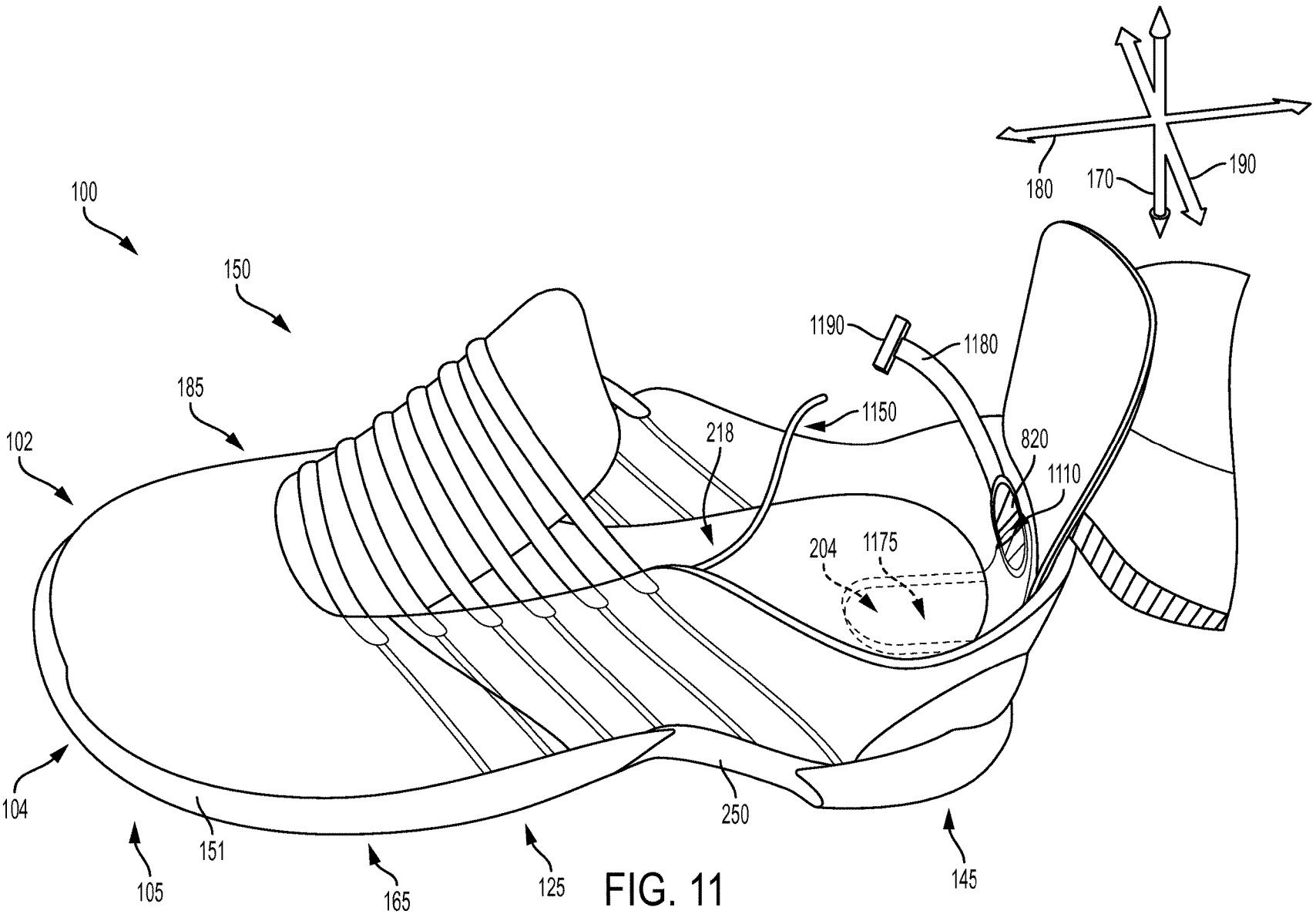
FIG. 11 is a schematic isometric view of an embodiment of an article of footwear and a component.
Figure 12:
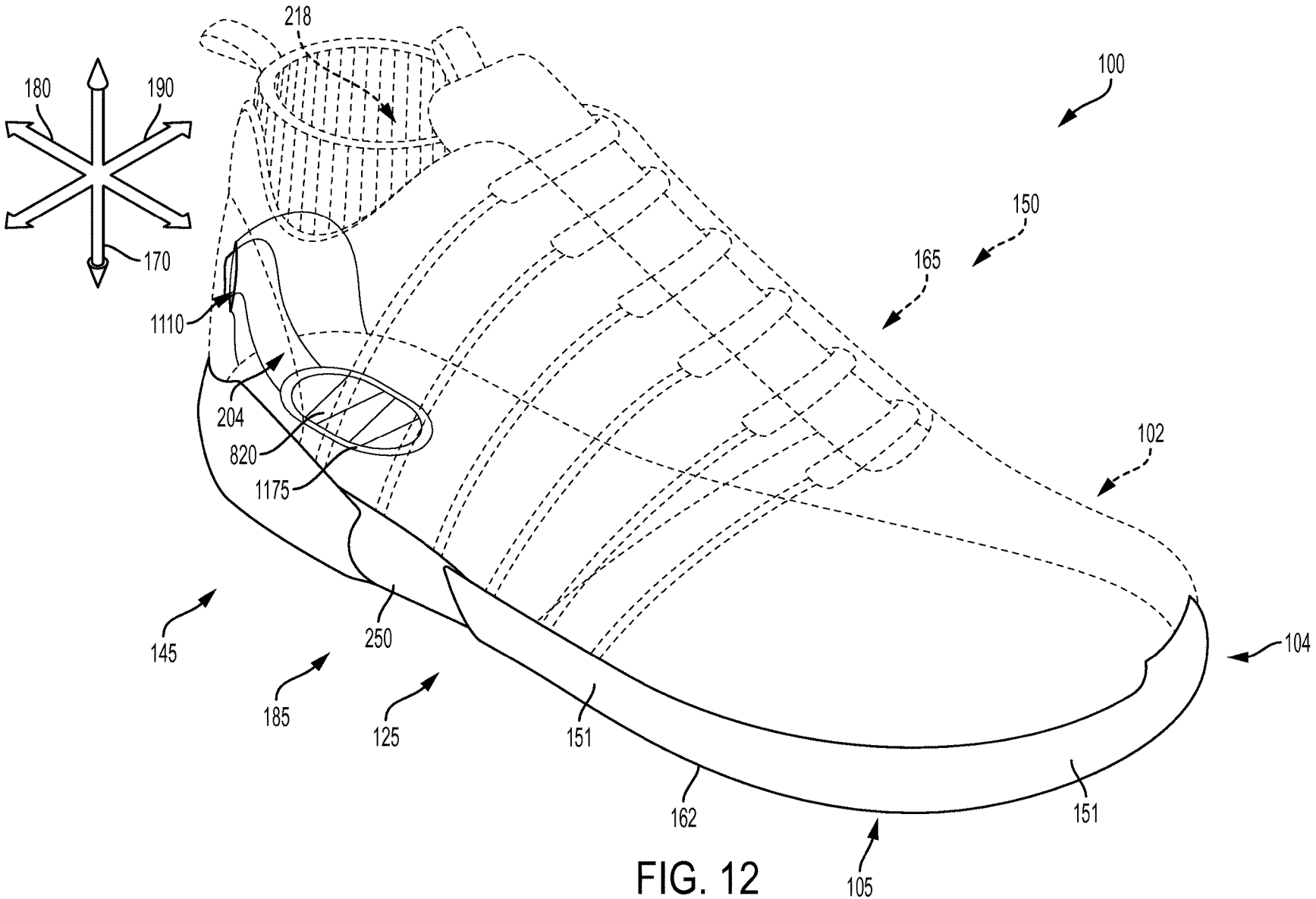
FIG. 12 is a schematic isometric view of an embodiment of an article of footwear and a component.

In different embodiments, control of a motorized lacing system or other electrical or automated features in an article can be accomplished using various processes and apparatuses. Referring now to FIGS. 11 and 12, some embodiments may utilize various kinds of devices for sending commands to a motorized tensioning system or other systems associated with article 100. For example, some embodiments can incorporate a variety of sensors for providing information to a control unit of a motorized tensioning system. In some embodiments, a sensor may provide a current as an input to a control unit. In some cases, for example, a predetermined current may be known to correspond to a certain pressure or weight. In one embodiment, pressure sensors could be used under the insoles of an article to indicate when the user is standing. In another embodiment, a motorized tensioning system can be programmed to automatically loosen the tension of the lace when the user moves from the standing position to a sitting position. Such configurations may be useful for older adults that may require low tension when sitting to promote blood circulation but high tension for safety when standing. In other embodiments, various features of a motorized tensioning system may turn on or off, or adjust the tension of a lace, in response to information from a sensor. In other embodiments, sensors may be used to provide information that can determine the activation of LED or other light sources. However, in other embodiments, it will be understood that the use of any sensor may be optional.

In different embodiments, the sensors providing information might include, but are not limited to, pressure sensors in shoe insoles to detect standing and/or rate of motion, bend indicators, strain gauges, gyroscopes, and accelerometers. In some embodiments, instead of or in addition to maintaining an initial tension, the sensor information may be used to establish a new target tension. For example, pressure sensors could be used to measure contact pressures of the upper of an article of footwear against the foot of a wearer and automatically adjust to achieve a desired pressure.

In some embodiments, sensors such as gyroscopes and accelerometers could be incorporated into article 100. In some embodiments, an accelerometer and/or gyroscope could be used to detect sudden moment and/or position information that may be used as feedback for adjusting lace tension, for example. These sensors could also be implemented to control periods of sleep/awake to extend battery life. In some cases, for example, information from these sensors could be used to reduce lacing tension in a system when the user is inactive, and increase lacing tension during periods of greater activity.

It is also contemplated that some embodiments could incorporate pressure sensors to detect high pressure regions that may develop during tightening. In some cases, the tension of the lace could be automatically reduced to avoid such high pressure regions. Additionally, in some cases, a system could prompt a user to alter the lacing arrangement associated with these high pressure regions.

It is further contemplated that in some embodiments a user could be provided with feedback through motor pulsing, which generates haptic feedback for the user in the form of vibrations/sounds. Such provisions could facilitate operation of a tensioning system directly, or provide haptic feedback for other systems in communication with a motorized tensioning device.

Various methods of automatically operating a motorized tensioning device in response to various inputs can be used. For example, after initially tightening a shoe, it is common for the lace tension to quickly decline in the first few minutes of use. Some embodiments of a tensioning system may include provisions for readjusting lace tension to the initial tension set by the user. In some embodiments, a control unit may be configured to monitor tension in those first minutes to then readjust tension to match original tension.

Referring to FIG. 11, second component 820, comprising a sensor, is shown adjacent to article 100. In some embodiments, the sensor may include various mechanisms or components that can be utilized for measuring current, pressure, or other properties in article 100. In different embodiments, the sensor may detect and measure a relative change in a force or applied load, detect and measure the rate of change in force, identify force thresholds and/or detect contact and/or touch.

In some cases, the sensor may comprise a generally two-dimensional material. In some embodiments, second component 820 may include a piezoelectric material. However, in other embodiments, second component 820 may comprise any desired object or element for insertion into article 100. The sensor may have different dimensions and/or shapes in different embodiments. In FIG. 11, second component 820 has a substantially oval or elliptical shape. In other embodiments, the dimensions and/or shape of second component 820 may differ.

In FIG. 11, a second portion of the connecting elements described above (now labeled as "second portion" 1150 for purposes of convenience) is shown as before contact with second component 820. In some embodiments, second component 820 may include a port or other accommodation for connecting with second portion 1150. For example, in FIG.

11, second component 820 has a port 1190 for contacting and/or connection to second portion 1150. In some embodiments, second component 820 may be linked to port 1190 via wiring disposed in a sheath 1180 or other type of protective or insulation covering.

In some embodiments, after a connection has occurred with second portion 1150, it may be desired to install second component 820 in article 100. However, it should be understood that installation of second component 820 may also occur without any prior (or subsequent) connection to an element of article 100. Referring now to FIGS. 11 and 12, a view of interior void 218 in upper 102 is depicted. The optional insole has been removed to reveal a portion of sole structure 104. As noted earlier, in some embodiments, sole structure 104 may include a region configured to receive or accommodate second component 820, here identified as second compartment 204. In different embodiments, second compartment 204 may be disposed in any layer of sole structure 104, including insole 216; in such cases, insole 216 would not need to be lifted to reveal second compartment 204, as removal of bootie 214 and/or collar lining 212 could sufficiently expose access to second compartment 204. In other cases, second compartment 204 may be disposed in sole plate 250, midsole 151, outsole 162, or any other portion of sole structure 104.

Second compartment 204 may also comprise a sleeve-like region disposed along a portion of upper 102. Thus, second compartment 204 may be at least partially bounded by one or more upper layers that together form a tunnel 1110. It should be understood that second compartment 204 may additionally include a slot or entryway that can provide access to the interior of tunnel 1110. In one embodiment, the slot may be secured or substantially closed after insertion of second component 820.

As shown in FIGS. 11 and 12, in some embodiments, second compartment 204 may also comprise a recess 1175 in sole structure 104. In one embodiment, second compartment 204 is disposed in midsole 151, along heel region 145. Recess 1175 may be bounded by one or more relatively shallow sidewalls in one embodiment. In some embodiments, the dimensions of recess 1175 may be designed or configured for secure and/or snug receipt of the sensor that comprises second component 820. In FIG. 12, recess 1175 includes a depth greater than a thickness of the sensor comprising second component 820. Furthermore, a first area associated with a first side of second component 820 may be less than a second area associated with the base of recess 1175. In other words, recess 1175 may be dimensioned to at least partially encompass or hold second component 820. In some embodiments, for example, the second area of recess 1175 may be slightly larger than the first area of second component 820, such that a substantially snug fit is formed between second component 820 and second compartment 204. However, in other embodiments, the dimensions of either second component 820 or second compartment 204 may differ such that one is substantially different from the other.

Thus, in some embodiments, second component 820 may be easily deposited or inserted into recess 1175 of midsole 151 without requiring the removal of midsole 151 from article 100. In other embodiments, however, it may be desirable to remove midsole 151 or another layer of sole structure 104 prior to installation of second component 820 into article 100.

Once second component 820 has been inserted, insole 216 may be replaced. Furthermore, if no other additional components are desired in article 100, bootie 214 and/or collar lining 212 or other removable elements may be returned to interior void 218 (see FIG. 18), which can substantially complete the installation process in one embodiment. However, in other embodiments, additional or different components may be incorporated, as discussed below.

Figure 13:
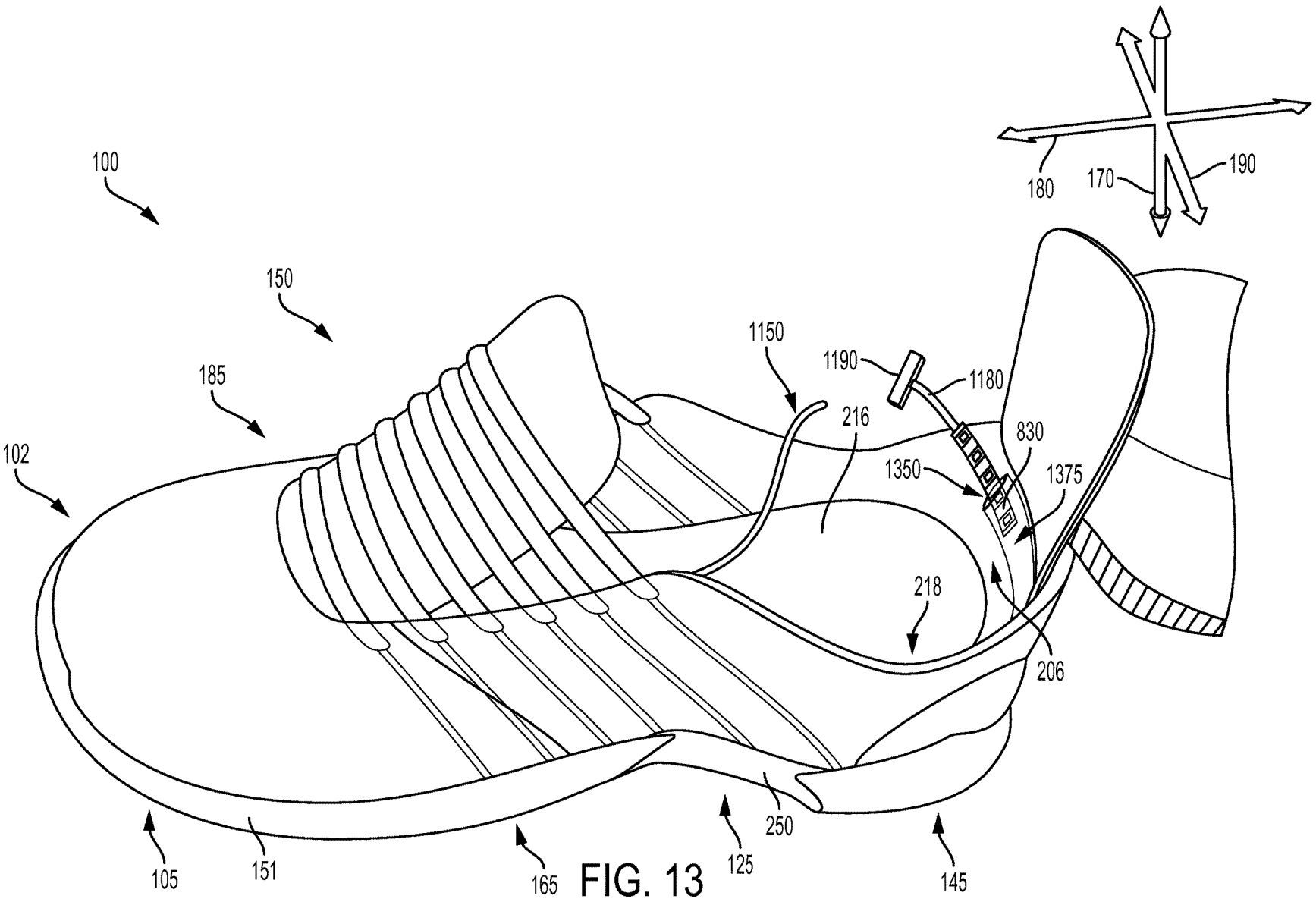
FIG. 13 is a schematic isometric view of an embodiment of an article of footwear and a component.
Figure 14:
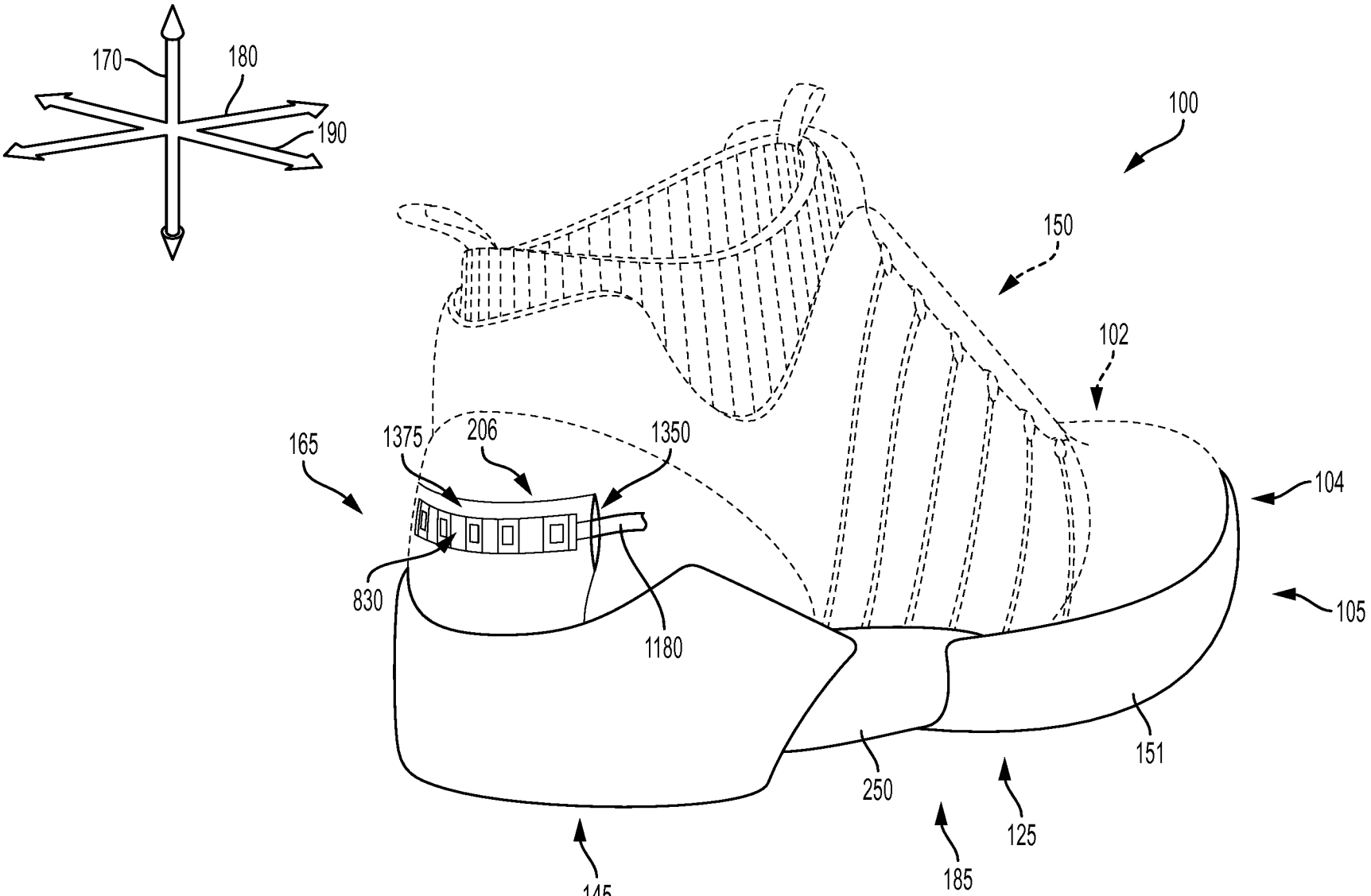
FIG. 14 is a schematic isometric view of an embodiment of an article of footwear and a component.

Referring now to FIG. 13, third component 830, comprising a light-emitting diode strip (referred to herein as an LED unit), is shown during installation into article 100. In some embodiments, the LED unit may include various mechanisms or components that can be utilized in tensioning system 150 (see FIG. 1). In some cases, the LED unit may include one or more LEDs of varying sizes, colors, and/or intensity levels. For example, third component 830 includes five LEDs. However, in other embodiments, third component 830 may comprise any desired object or element for insertion into article 100. The LED unit may have different dimensions and/or shapes in different embodiments. In FIG. 13, third component 830 has a substantially two-dimensional shape. Furthermore, the LEDs are disposed along a substantially continuous, rectangular-shaped and relatively narrow strip.

In FIG. 13, second portion 1150 of connecting elements is shown prior to contact with third component 830 via port 1190. In other words, in some embodiments, third component 830 and second component 820 may share a common port or connecting portion along wires disposed along a common sheath 1180. In other embodiments, two or more components may include their own individual port and/or wiring assembly. In FIG. 13, third component 830 has port 1190 for contacting and/or connection to second portion 1150. Furthermore, the substantially same portion of connecting elements may contact both second component 820 and third component 830 in some embodiments.

In some embodiments, after a connection has occurred with connecting element 710, it may be desired to install third component 830 in article 100. However, it should be understood that installation of third component 830 may also occur without any prior (or subsequent) connection to an element of article 100.

Third compartment 206 may comprise a sleeve-like region disposed along a portion of upper 102 in some embodiments. Third compartment 206 may be at least partially bounded by one or more upper layers that together form a tunnel 1375. It should be understood that third compartment 206 may additionally include a slot 1350 that can provide access to the interior of tunnel 1375. In one embodiment, slot 1350 may be secured or substantially closed after insertion of third component 830. In other embodiments, tunnel 1375 and/or slot 1350 may be substantially similar to the slot and tunnel described above for use with second component 820. However, in other embodiments, the slot and tunnels used may be different.

In some embodiments, the dimensions of tunnel 1375 may be designed or configured for secure and/or snug receipt of the LED unit of third component 830. For example, in FIG. 14, tunnel 1475 includes a diameter greater than a width of the LED unit of third component 830. Furthermore, a first length associated with the LED unit may be less than a second length associated with tunnel 1375 of third compartment 206. In other words, tunnel 1375 may be dimensioned to at least partially encompass, accommodate or hold third component 830. In some embodiments, for example, the second length of tunnel 1375 may be slightly larger than the first length of the LED unit, such that a substantially snug fit is formed between third component 830 and third compartment 206. However, in other embodiments, dimensions of either third component 830 and third compartment 206 may differ such that one is substantially different from the other. For example, depending on the length and size of the portion of sheath 1180 that is incorporated into upper 102, tunnel 1375 can be extended to accommodate the wiring associated with third component 830.

Thus, in some embodiments, third component 830 may be easily slid or inserted into tunnel 1375 in upper 102 without requiring the removal of various layers of upper 102. Once third component 830 has been inserted, if no other additional components are desired in article 100, bootie 214 and/or collar lining 212 or other removable elements may be returned to interior void 218 (see FIG. 18), which can substantially complete the installation process in one embodiment. However, in other embodiments, additional or different components may be incorporated, as discussed below.

As noted above with respect to second component 820 in FIGS. 11-12, some embodiments of article 100 may utilize various kinds of devices for sending or transmitting commands to a motorized tensioning system or other mechanisms. In some embodiments, buttons for tightening, loosening and/or performing other functions can be located directly on or in an article. For purposes of this disclosure, buttons refer to a material or element that can be pressed or otherwise configured to operate a mechanism, such as a tab, switch, knob, control, lever, handle, or other such control means.

Figure 15:
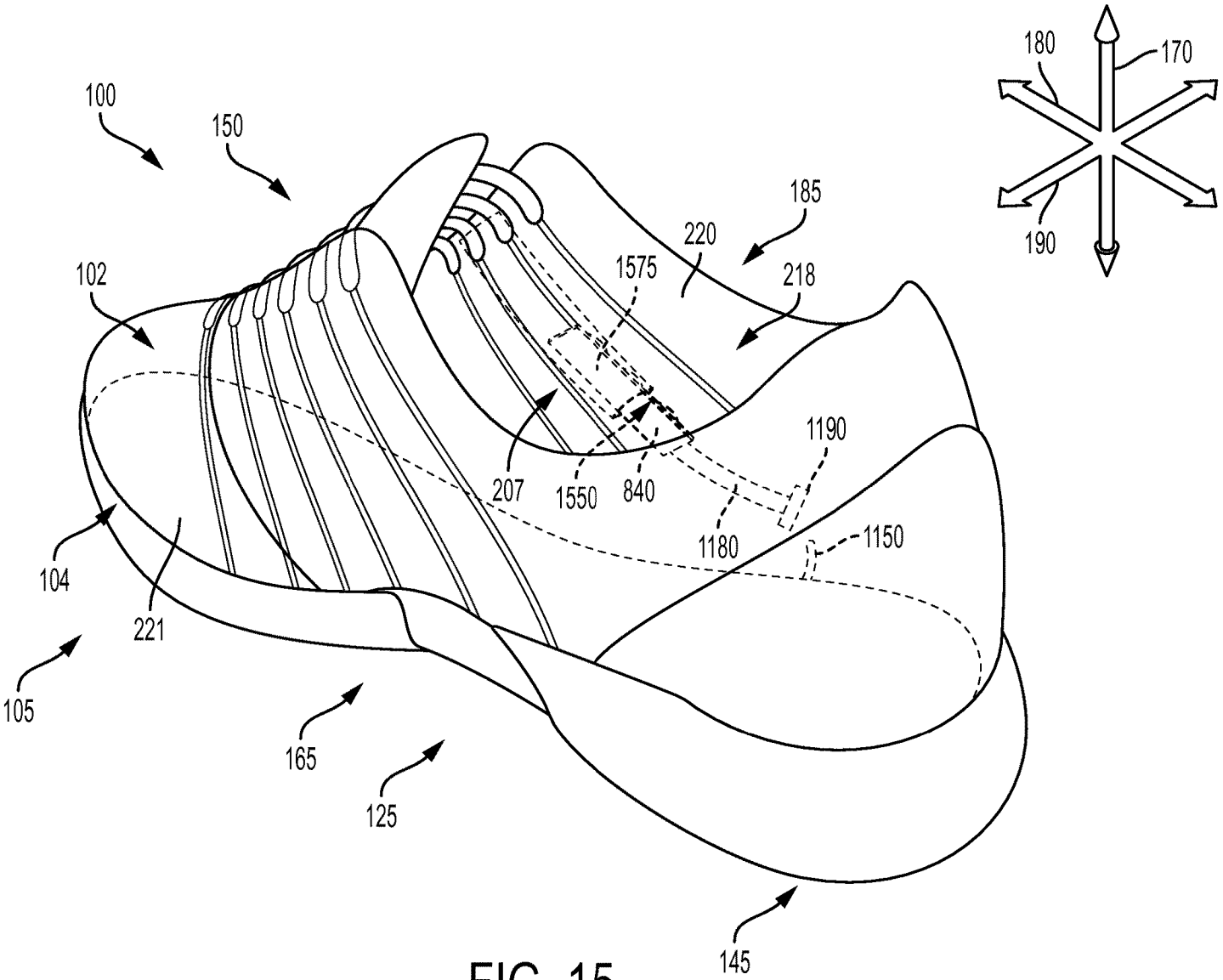
FIG. 15 is a schematic isometric view of an embodiment of an article of footwear and a component.
Figure 16:
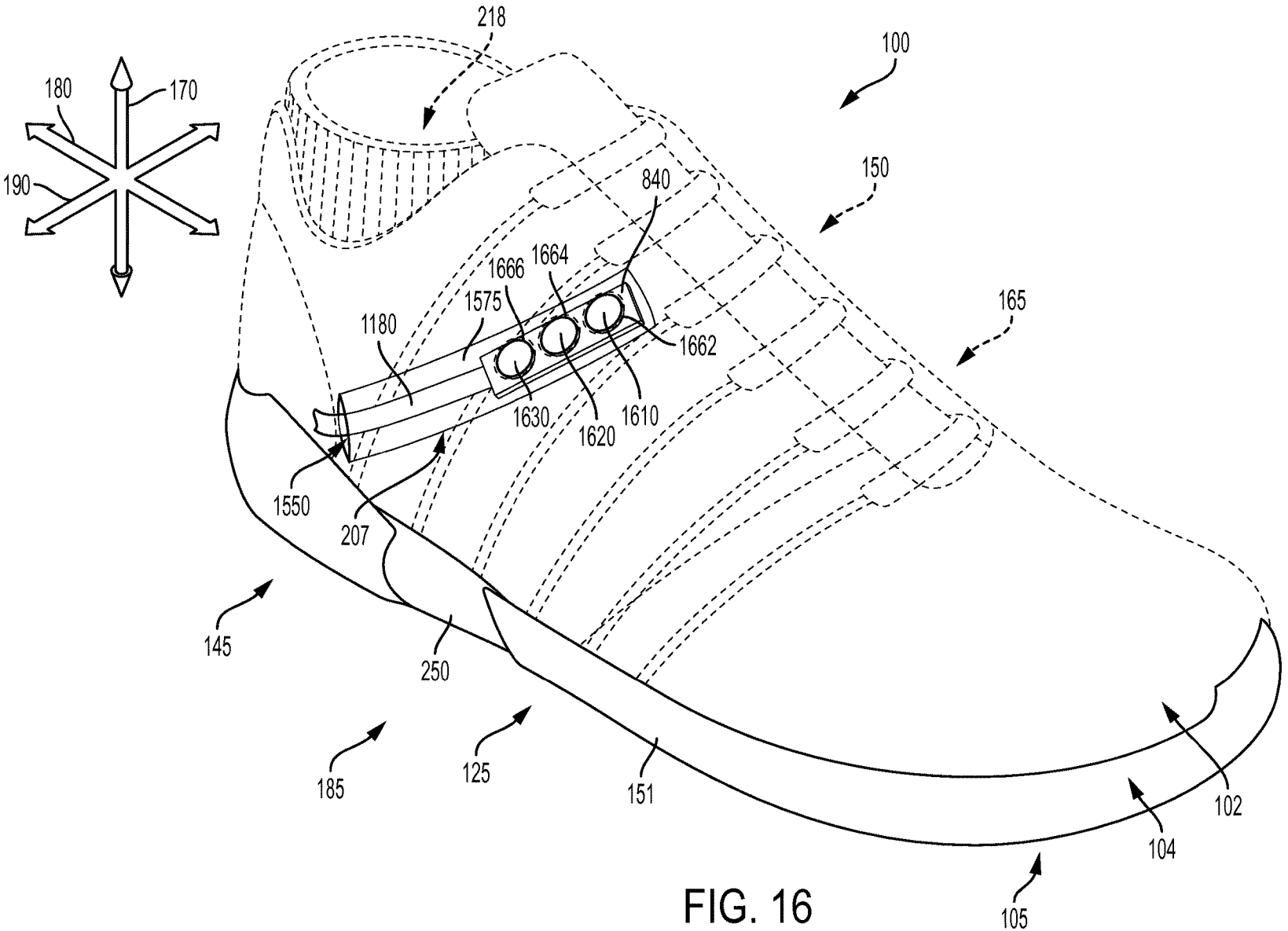
FIG. 16 is a schematic isometric view of an embodiment of an article of footwear and a component.

Referring to FIGS. 15 and 16, in some cases, fourth component 840 may include one or more buttons for initiating incremental tightening and incremental loosening commands, for example. In other embodiments, additional buttons can be included for initiating any other commands including the open command (or fully loosen command), store tension command and return to stored tension command. Still other embodiments could incorporate any other buttons for issuing any other kinds of commands.

Referring to FIG. 15, fourth component 840, comprising a control unit or button board, is shown as being installed within fourth compartment 207 of article 100. In some embodiments, the "button board" may include various switches, mechanisms or components that can be utilized for measuring current, pressure, or other properties in article 100. In different embodiments, the button board may detect and measure a relative change in a force or applied load, detect and measure the rate of change in force, identify force thresholds and/or detect contact and/or touch.

In some cases, the button board may comprise a generally two-dimensional material. In some embodiments, fourth component 840 may include one or more buttons. In FIG. 16, fourth component 840 includes a first button 1610, a second button 1620, and a third button 1630. However, in other embodiments, fourth component 840 may comprise any desired object or element for insertion into article 100, and/or any number of buttons. The button board may further have different dimensions and/or shapes in different embodiments. In FIG. 16, the buttons are disposed along a substantially continuous, rectangular-shaped and relatively narrow strip. In other embodiments, the dimensions and/or shape of fourth component 840 may differ.

In FIG. 15, second portion 1150 of connecting element 710 is shown prior to contact with fourth component 840 via port 1190. In other words, in some embodiments, fourth component 840, third component 830, and second component 820 may share a common port or connecting portion along wires disposed along a common sheath 1180. In other embodiments, two or more components may include their own individual port and/or wiring assembly. In FIG. 15, fourth component 840 has port 1190 for contacting and/or connection to second portion 1150 of connecting elements.

In some embodiments, after a connection has occurred with connecting element 710, it may be desired to install fourth component 840 in article 100. However, it should be understood that installation of fourth component 840 may also occur without any prior (or subsequent) connection to an element of article 100.

Referring to FIGS. 15 and 16, fourth compartment 207 may comprise a sleeve-like region disposed along a portion of upper 102 in some embodiments. Fourth compartment 207 may be at least partially bounded by one or more upper layers that together form a tunnel 1575. It should be understood that fourth compartment 207 may additionally include a slot 1550 that can provide access to the interior of tunnel 1575. In one embodiment, slot 1550 may be secured or substantially closed after insertion of fourth component 840. In addition, fourth compartment 207 may include provisions for allowing access to the buttons or other control mechanisms. In FIG. 16, for example, a first hole 1662, a second hole 1664, and a third hole 1666 comprising apertures in a portion of upper 102 are depicted. In some embodiments, when fourth component 840 is installed in upper 102, first hole 1662 may be aligned with first button 1610, second hole 1664 may be aligned with second button 1620, and third hole 1666 can be aligned with third button 1630. In other words, some compartments may include exposed portions that allow external user contact with at least a portion of any installed components.

In different embodiments, the dimensions of tunnel 1575 may be designed or configured for secure and/or snug receipt of the button board of fourth component 840. For example, in FIGS. 15 and 16, tunnel 1575 includes a diameter greater than a width associated with the button board of fourth component 840. Furthermore, a first length associated with the button board may be less than a second length associated with tunnel 1575 of fourth compartment 207. In other words, tunnel 1575 may be dimensioned to at least partially encompass, accommodate, or hold fourth component 840. In some embodiments, for example, the second length of tunnel 1575 may be slightly larger than the first length of the button board, such that a substantially snug fit is formed between fourth component 840 and fourth compartment 207. However, in other embodiments, dimensions of either fourth component 840 and fourth compartment 207 may differ such that one is substantially different from the other. For example, depending on the length and size of the portion of sheath 1180 that is incorporated into upper 102, tunnel 1575 can be extended to accommodate the wiring associated with fourth component 840.

Thus, in some embodiments, fourth component 840 may be easily slid or inserted into tunnel 1575 in upper 102 without requiring the removal of various layers of upper 102. Once fourth component 840 has been inserted, if no other additional components are desired in article 100, bootie 214 and/or collar lining 212 or other removable elements may be returned to interior void 218 (see FIG. 18), which can substantially complete the installation process in one embodiment. However, in other embodiments, additional or different components may be incorporated, as discussed earlier.

Figure 17:
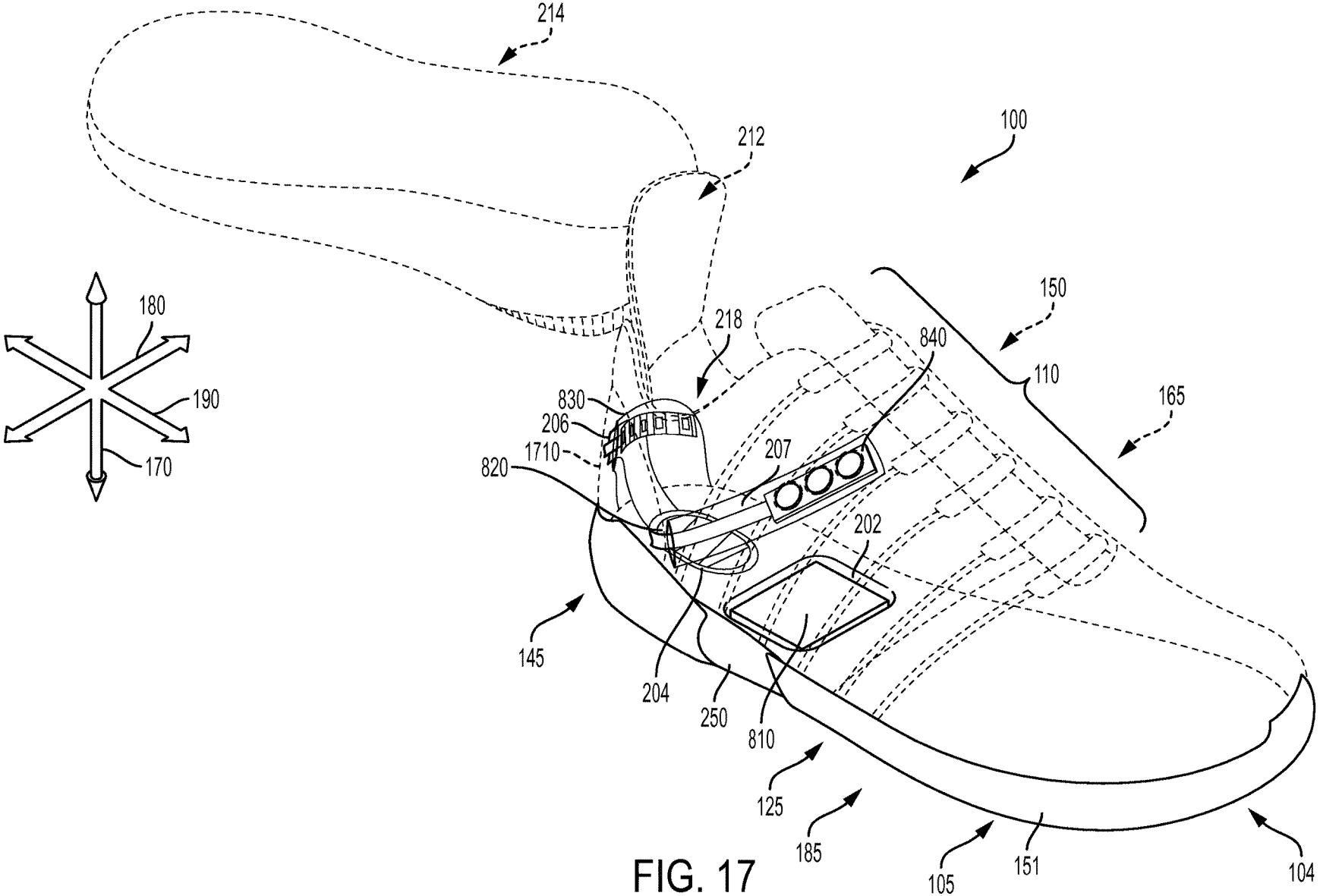
FIG. 17 is a schematic isometric view of an embodiment of an article of footwear and some components.

Referring now to FIG. 17, article 100 is illustrated with components 800 installed. In FIG. 17, upper 102 and sole structure 104 are depicted in dotted line to provide a view of interior void 218 and various compartments. It can be seen that first component 810 is disposed in first compartment 202 along sole plate 250. Furthermore, second component 820 is disposed in second compartment 204 along heel region 145. In addition, third component 830 is disposed in third compartment 206 adjacent to a heel counter 1710 along upper 102. Finally, fourth component 840 is disposed in fourth compartment 207 along instep region 110.

In other embodiments, any of the components could be disposed in any other portions of an article, including the upper and/or sole structure. In some cases, some components could be disposed in one portion of an article and other components could be disposed in another, different, portion. In another embodiment, for example, first component 810 comprising a housing unit with a motorized tensioning device could be disposed near the heel of article 100, while fourth component 840 could be disposed near forefoot region 105 of article 100. The location of one or more components may be selected according to various factors including, but not limited to: size constraints, manufacturing constraints, aesthetic preferences, optimal design and functional placement, ease of removability or accessibility relative to other portions of article 100, as well as possibly other factors.

Figure 18:
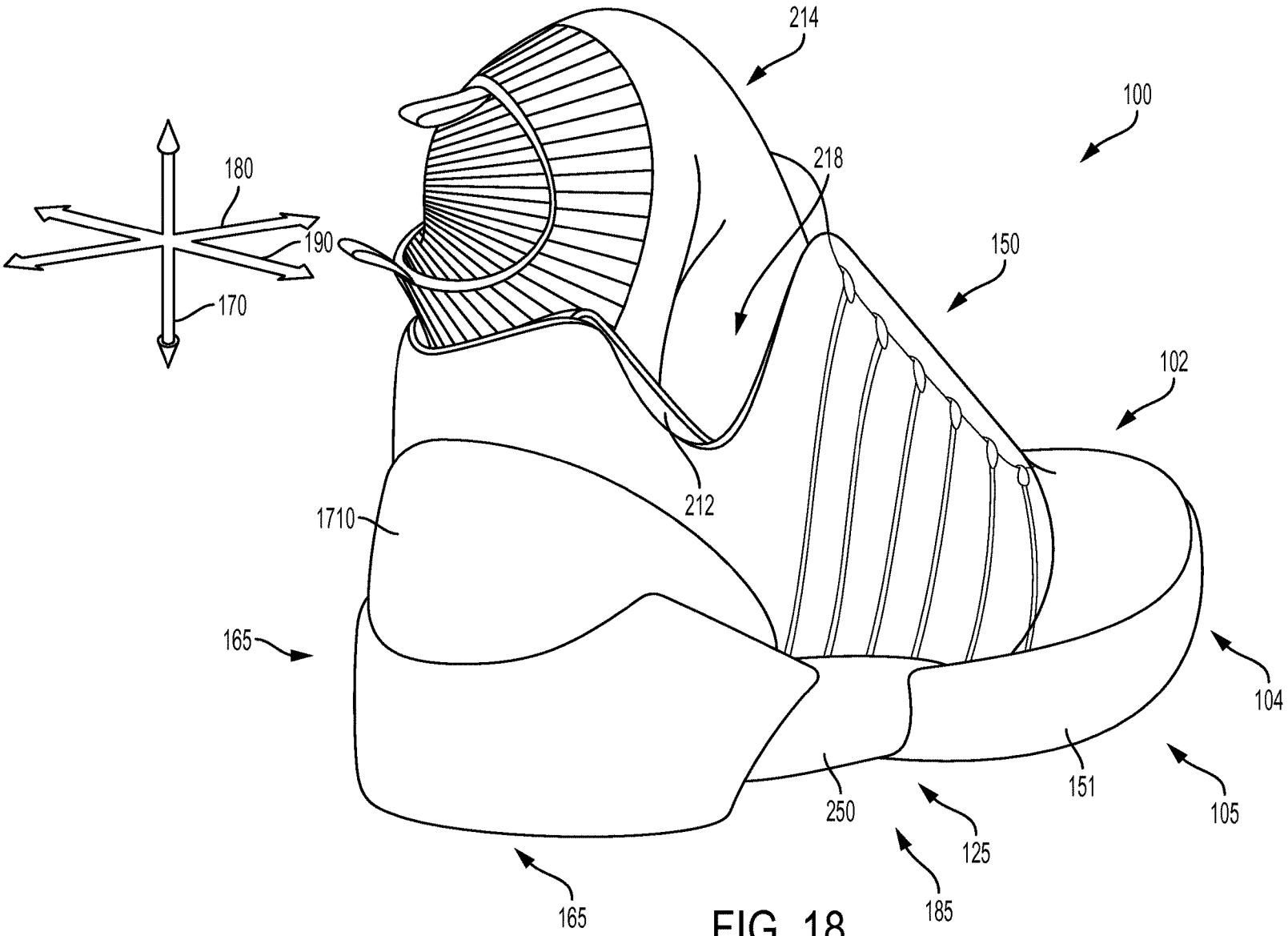
FIG. 18 is a schematic isometric view of an embodiment of an article of footwear.

As discussed with respect FIGS. 3-6, bootie 214 and/or collar lining 212 (or other removable elements) may be moved relative to their original, assembled positions in article 100. FIG. 18 provides an embodiment of article 100 as bootie 214 and collar lining 212 are returned to resume a position within interior void 218. In other words, after installation of the desired components, article 100 is configured for a ready return to an assembled state, where a user may wear article 100. Furthermore, the insertion of bootie 214 and/or collar lining 212 may cover and/or further conceal the various compartments of article 100. In addition, bootie 214 and/or collar lining 212 can improve the security or incorporation of components within article 100 when they are replaced in upper 102 by pressing or closing off any regions that were exposed for accessibility.

Figure 19:
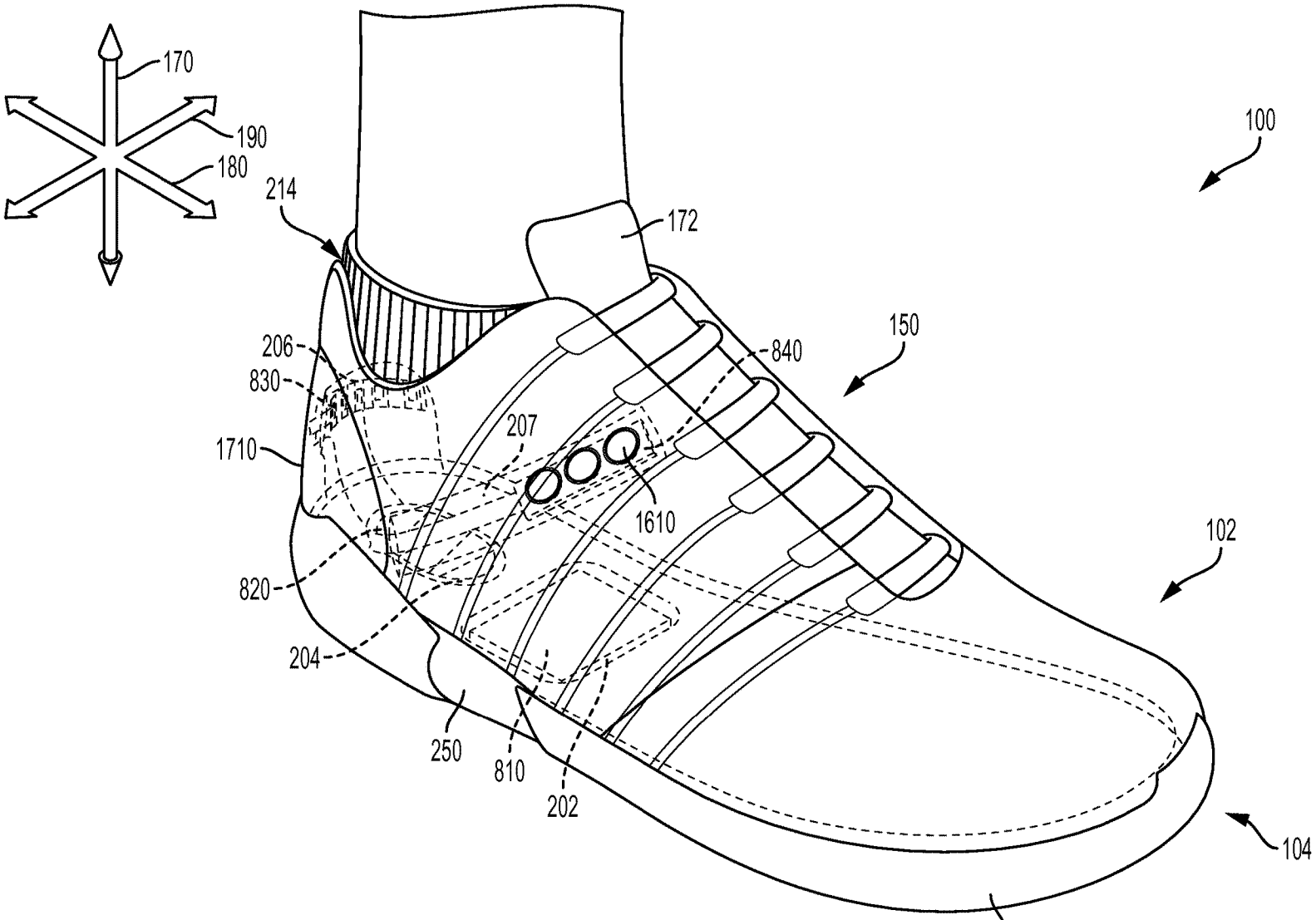
FIG. 19 is a schematic isometric view of an embodiment of an article of footwear.

Once components have been installed in article 100, various systems may be operated, enjoyed, or used by a wearer. For example, referring to FIG. 19, a tensioning system 150 may be completed and/or supplemented by the installation of components. Furthermore, in some embodiments, as a result of the integration of various components within article 100, it can be possible for two or more components to work in concert or conjunction with one another. For example, in one embodiment, when pressure is exerted on the sensor comprising second component 820, a signal may be transmitted to activate the LED unit of third component 830. Thus, during walking, when the heel applies pressure in article 100 (stepping downward), the LED lights can turn on, and/or after the heel has been lifted, the LED lights can turn off, or vice versa. Furthermore, some regions of article 100 may be configured for providing optimal use of various components. In one example, one or more regions of article 100 such as heel counter 1710 may include light-diffusive, light-transmissive, translucent, or transparent materials, to facilitate the transmission of light from an LED that has been incorporated during or after manufacture of article 100. Referring to FIG. 19, heel counter 1710 may be formed of a light-diffusive material, for example. Thus, third component 830 comprising LED unit may emit light that can be visible to the wearer or others via the diffuse material of heel counter 1710. In some embodiments, an enhanced aesthetic design may be produced by the use of various materials with LED unit. In another example, components can interact with a tensioning device to activate or operate tensioning system 150. In one embodiment, a wearer can press first button 1610 of fourth component 840 to initiate an open, or fully loosen, command in tensioning system 150, as an example.

Thus, in different embodiments, an article may be manufactured that has one or more compartments configured to receive components. In one embodiment, such as articles with a tensioning system, an article may have multiple components installed after a "first stage" manufacturing process. In a separate installation process or "second stage", as generally described above, one or more components may be installed throughout article 100. This process is generally represented in the flow diagrams of FIGS. 20-21, which represent two embodiments of a method for making an article of footwear with an automated, electronic, and/or mechanical system (for example, a fastening or tensioning system), where components of the system are installed during a post-manufacturing process.

Figure 20:
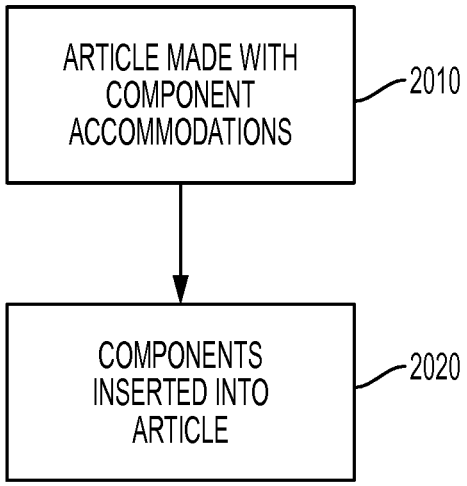
FIG. 20 is an embodiment of a flow chart for a method of assembling an article with components.

FIG. 20 provides two main steps, including a first step 2010, where an article is made using techniques, such as one or more in-line article making techniques. The article also includes accommodations for one or more components. In a second step 2020, the component(s) is inserted into the in-line article (for example, by hand). It should be understood that the assembly process of first step 2010 produces an article of footwear that can have specific accommodations dimensioned to receive the various electromechanical components of the automated system.

Figure 21:
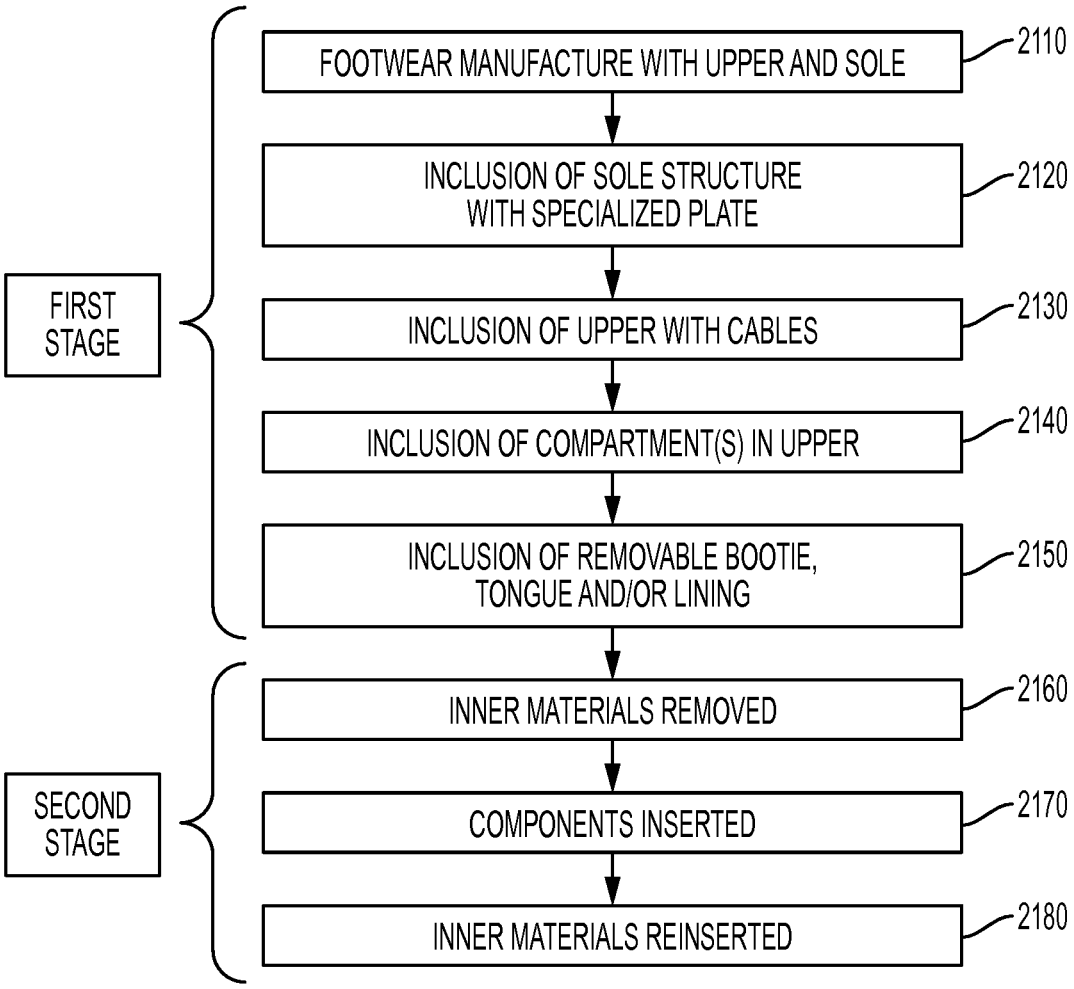
FIG. 21 is an embodiment of a flow chart for a method of assembling an article with components.

Referring to FIG. 21, in some embodiments, a first step 2110 may involve beginning assembly or manufacture of in-line footwear, where the article includes a sole structure and an upper. Furthermore, in a second step 2120, the sole structure can include a specialized plate for receiving an electronic control unit, and/or a recess for receiving a heel sensor. In a third step 2130, the upper can include a cable or wiring that is routed from the sole structure through tubes along one side (on the medial or lateral side) of the upper, and then back and forth over the instep region of the upper through additional series of tubes. In a fourth step 2140, the upper can also include a compartment for receiving an LED unit, as well as a compartment for receiving a button board. Any of these steps may be optional, however.

In the factory assembled article of a fifth step 2150, there can be a removable bootie or tongue, as well as a removable collar lining, included in the manufacture of the upper. In other words, the collar lining, bootie, and other types of inner liner materials (i.e., removable elements) can be stitched or otherwise joined onto the upper during manufacture of the article. The stitching is directed to specialized portions of the inner liner materials so that while they generally remain attached or anchored to a portion of the upper, they can be easily removed and/or reinserted.

In a sixth step 2160, beginning a second stage of the process, some of the inner materials are pulled out, revealing the interior compartments and/or the various accommodations for receiving additional components. In other words, the removal of these inner liner materials allows access to portions of the interior cavity of article that were covered previously.

In a seventh step 2170, various electronic or mechanical components are inserted into the article (such as an LED in the heel, a heel sensor in the sole structure, a button board in the instep region, and/or an electronic control unit in the sole plate). In some cases, the components can be hand-inserted.

Thus, the article may be "opened up" without damage to the article, and the cables or other elements/areas that had been assembled within the interior of the shoe during manufacture in first step 2110 may be readily accessed in later steps. Once the desired components have been inserted, the inner materials may be easily reinserted in a eighth step 2180, and the exposed portions of the article are covered again.

The embodiments of FIGS. 20 and 21 as described herein may occur in rapid succession and in close proximity to one another in some embodiments. However, in other embodiments, one or more steps may occur spaced apart in time and location. In other words, one step may occur in a first location, and another step may occur in a second location, where the first location is different from the second location. For example, the manufacture of the article in first step 2010 and/or first step 2110 may occur off-site (e.g., at a factory or manufacturing facility), and the installation of components of later steps may take place at a second, different location (at a shopping outlet, retail store, or a residence, a separate manufacturing facility, etc.). In another example, the manufacture of the article in first step 2010 and/or first step 2110 may occur in a "remote site" (e.g., out of state, or abroad), while the actual insertion of the components of later steps may occur in a "local site" (e.g., within the country or state where the item or article will be sold and/or used), or vice-versa.

Furthermore, the embodiments described herein may also include or refer to techniques, concepts, features, elements, methods, and/or components from U.S. Patent Publication Number US-2016-0345653 A1, published Dec. 1, 2016, (previously U.S. patent application Ser. No. 14/723,832, filed May 28, 2015), titled "A Disable Function for a Control Device," U.S. Patent Publication Number US-2016-0345654 A1, published Dec. 1, 2016, (previously U.S. patent application Ser. No. 14/723,880, filed May 28, 2015), titled "A Charging System for an Article of Footwear," and U.S. Patent Publication Number US-2016-0345671 A1, published Dec. 1, 2016, (previously U.S. patent application Ser. No. 14/723,994, filed May 28, 2015), titled "A Sole Plate for an Article of Footwear," and U.S. Patent Publication Number US-2016-0345655 A1, published Dec. 1, 2016, (previously U.S. patent application Ser. No. 14/724,007, filed May 28, 2015), titled "A Control Device for an Article of Footwear," the entirety of each application being herein incorporated by reference.

While various embodiments have been described, the description is intended to be exemplary, rather than limiting and it will be apparent to those of ordinary skill in the art that many more embodiments and implementations are possible that are within the scope of the embodiments. Although many possible combinations of features are shown in the accompanying figures and discussed in this detailed description, many other combinations of the disclosed features are possible. Any feature of any embodiment may be used in combination with or substituted for any other feature or element in any other embodiment unless specifically restricted. Therefore, it will be understood that any of the features shown and/or discussed in the present disclosure may be implemented together in any suitable combination. Accordingly, the embodiments are not to be restricted except in light of the attached claims and their equivalents. Also, various modifications and changes may be made within the scope of the attached claims.

What is claimed is:

1. An article of footwear, comprising:

a sole structure, including a midsole, an outsole, and a sole plate, the midsole disposed between the outsole and the sole plate, the sole plate forming a compartment;

an upper, secured with respect to the sole structure, comprising an inner surface and forming an inner void configured to admit a foot of a wearer of the article of footwear, the compartment being accessible from the inner void;

at least one bootie configured to be removable from, and re-insertable within, the inner void after manufacture of the article of footwear, wherein a portion of the at least one bootie is fixedly attached to a portion of the upper and the bootie is configured to fully enclose the foot; and a plurality of lacing guides secured to the upper; and a motorized tensioning system, comprising:

a lace extending through the lacing guides; and a motorized tensioning device removably seated in the compartment via the inner void, the motorized tensioning device comprising a motor and a power source operatively coupled to and configured to drive the motor, the lace operatively coupled to the motorized tensioning device;

wherein operating the motorized tensioning system causes tension to be placed on or removed from the lace;

wherein the compartment is sized to fully contain the motorized tensioning device and the removal of the at least one bootie provides access to the compartment; and wherein the upper includes a first layer and a second layer, wherein a tunnel configured to receive an electronic component is disposed between the first layer and the second layer.

2. The article of footwear of claim 1, wherein the compartment is disposed in the sole structure and the tunnel is disposed in the upper and accessible from the inner void, wherein the removal of the at least one bootie provides access to the compartment and the tunnel.

3. The article of footwear of claim 2, wherein the compartment is configured to seat the motorized tensioning device and the tunnel is configured to seat the electronic component, wherein the electronic component is a control panel configured to control operation of the motorized tensioning system.

4. The article of footwear of claim 3, wherein the control panel is configured to be operatively coupled to the motorized tensioning system when the control panel is seated in the tunnel and the motorized tensioning system is seated in the compartment.

5. The article of footwear of claim 1, wherein the bootie is arranged to be adjacent to a majority of the inner surface of the upper, and further comprising an insole positioned between the bootie and motorized tensioning device seated within the compartment.

6. The article of footwear of claim 1, further comprising a collar lining.

7. The article of footwear of claim 6, wherein removal of the bootie provides access to the compartment and removal of the collar lining provides access to the tunnel.

8. The article of footwear of claim 1, wherein the sole structure includes a heel region, wherein the heel region of the sole structure includes the compartment, and wherein the compartment comprises a recess configured to receive the motorized tensioning system.

9. The article of footwear of claim 1, wherein the upper includes a heel counter, wherein the tunnel is disposed adjacent to the heel counter, and wherein the heel counter comprises a light diffusive material.

10. The article of footwear of claim 1, wherein the lace is disposed, at least in part, between the first layer and the second layer.

11. The article of footwear of claim 4, wherein the control panel has a light emitting diode (LED) panel.

* * * * *